US012440882B2

(12) United States Patent
Otsuka et al.

(10) Patent No.: US 12,440,882 B2
(45) Date of Patent: Oct. 14, 2025

(54) BURRING PROCESSING METHOD, METHOD FOR MANUFACTURING BURRING PROCESSED PRODUCT, BURRING PROCESSING MOLD, BURRING PROCESSING DEVICE, AND BURRING PROCESSED PRODUCT

(71) Applicant: NIPPON STEEL CORPORATION, Tokyo (JP)

(72) Inventors: Kenichiro Otsuka, Tokyo (JP); Masafumi Azuma, Tokyo (JP); Yasuhiro Ito, Tokyo (JP); Toru Yonebayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 148 days.

(21) Appl. No.: 18/014,427

(22) PCT Filed: Jul. 9, 2021

(86) PCT No.: PCT/JP2021/025934
§ 371 (c)(1),
(2) Date: Jan. 4, 2023

(87) PCT Pub. No.: WO2022/009978
PCT Pub. Date: Jan. 13, 2022

(65) Prior Publication Data

US 2023/0241662 A1 Aug. 3, 2023

(30) Foreign Application Priority Data

Jul. 9, 2020 (JP) ..... 2020-118459

(51) Int. Cl.
*B21D 19/08* (2006.01)
*B60G 7/00* (2006.01)

(52) U.S. Cl.
CPC ..... *B21D 19/08* (2013.01)

(58) Field of Classification Search
CPC ..... B21D 19/08; B21D 19/088
See application file for complete search history.

(56) References Cited

U.S. PATENT DOCUMENTS

2007/0204466 A1 9/2007 Fisk
2007/0234776 A1 10/2007 Shiga et al.
(Continued)

FOREIGN PATENT DOCUMENTS

JP 58-44917 A 3/1983
JP 2009-6392 A 1/2009
(Continued)

OTHER PUBLICATIONS

English translate (JP2018051609A), retrieved date Dec. 16, 2024.*

*Primary Examiner* — Mohammed S. Alawadi
(74) *Attorney, Agent, or Firm* — Birch, Stewart, Kolasch & Birch, LLP

(57) ABSTRACT

A burring processing method including increasing a diameter of a prepared hole provided in a metal component and bending a part of the metal component to form a burring processed portion (110) including an upright portion (120) and a curved portion (130), wherein in a cross-section that passes through an axis (cb) of the burring processed portion (110) and is parallel to the axis (cb) of the buffing processed portion (110), a cross-sectional shape of the curved portion (130) on an inner surface of the curved portion consists of a curve, and a length of the curved portion (130) in a direction perpendicular to the axis (cb) of the burring processed portion (110) is at least 1.2 times a height of the curved portion in a direction parallel to the axis (cb) of the burring processed portion (110).

10 Claims, 14 Drawing Sheets

(56) References Cited

U.S. PATENT DOCUMENTS

| | | | | |
|---|---|---|---|---|
| 2011/0115186 | A1 | 5/2011 | Chiku et al. | |
| 2018/0043412 | A1 * | 2/2018 | Isogai ..... | B21D 28/26 |

FOREIGN PATENT DOCUMENTS

| | | | | |
|---|---|---|---|---|
| JP | 2018-51609 | A | | 4/2018 |
| JP | 2018051609 | A | * | 4/2018 |
| WO | WO 2010/004899 | A1 | | 1/2010 |

* cited by examiner

BURRING PROCESSING METHOD, METHOD FOR MANUFACTURING BURRING PROCESSED PRODUCT, BURRING PROCESSING MOLD, BURRING PROCESSING DEVICE, AND BURRING PROCESSED PRODUCT

TECHNICAL FIELD

The present invention relates to a burring processing method, a method for manufacturing a buffing processed product, a buffing processing mold, a burring processing device, and a buffing processed product. Priority is claimed on Japanese Patent Application No. 2020-118459, filed Jul. 9, 2020, the content of which is incorporated herein by reference.

BACKGROUND ART

There is a technique of forming a substantially cylindrical burring processed portion by performing buffing processing on a prepared hole provided in a metal component or a metal plate that is a workpiece. In this burring processing, a circumferential portion of the prepared hole is extruded and a part thereof is formed into a cylindrical shape to form the buffing processed portion. In the buffing processed portion, a cylindrical flange (an upright portion) is connected to a part of the metal component or the metal plate at a circumferential portion thereof via a curved portion. Fatigue characteristics and dimensional accuracy are required for the buffing processed portion. For example, Patent Document 1 discloses a technique in which a compressive stress is applied to an end portion of a burring processed portion by coining to relax a tensile residual stress, and a compressive stress is locally concentrated on an inner surface of a bend of a curved portion constituting a root of the buffing processed portion to inhibit wrinkles or cracks that occur on the inner surface. Also, as a burring processing technique, there is an ironing burring processing method as described in Patent Document 2.

CITATION LIST

Patent Document

Patent Document 1

Japanese Unexamined Patent Application, First Publication No. 2018-051609

Patent Document 2

Japanese Unexamined Patent Application, First Publication No. S58-44917

SUMMARY OF INVENTION

Problems to be Solved by Invention

Incidentally, a burring processed portion is also used for undercarriage components of a vehicle. In particular, undercarriage components of a vehicle such as a lower arm and a trailing arm are required to have fatigue characteristics, but with some burring processing methods, a tensile residual stress is likely to occur inside a curved portion of a buffing processed portion. When a fatigue load is applied to a component in which a tensile residual stress occurs inside a curved portion of a burring processed portion, the burring processed portion may be deformed. In addition, depending on a burring processing method, minute cracks (in-bend cracks) may occur inside the curved portion, and it may be necessary to change a shape such as increasing the radius of curvature of the curved portion.

The present invention has been made in view of the above problems, and an object of the present invention is to provide a burring processing method, a method for manufacturing a buffing processed product, a buffing processing mold, a burring processing device, and a buffing processed product in which generation of cracks in a curved portion of a burring processed portion can be inhibited.

Means for Solving the Problem (1) A burring processing method according to one aspect of the present invention is a method for increasing a diameter of a prepared hole provided in a metal component and bending a part of the metal component to form a buffing processed portion including an upright portion and a curved portion, in which, in a cross-section that passes through an axis of the buffing processed portion and is parallel to the axis of the buffing processed portion, a cross-sectional shape of the curved portion on an inner surface of the curved portion consists of a curve, and a length of the curved portion in a direction perpendicular to the axis of the burring processed portion is at least 1.2 times a height of the curved portion in a direction parallel to the axis of the buffing processed portion.

(2) A burring processing method according to one aspect of the present invention is a method for forming a burring processed portion in a metal component provided with a prepared hole using a mold including a die having a die hole, a holder, and a punch, in which the metal component is sandwiched between the die and the holder, the punch is inserted into the die hole along an axis of the die hole to increase a diameter of the prepared hole and to bend a part of the metal component, thereby forming a burring processed portion including an upright portion and a curved portion, and in a cross-section that passes through the axis of the die hole and is parallel to the axis of the die hole, a cross-sectional shape of a die shoulder consists of a curve, and a length of the die shoulder in a direction perpendicular to the axis of the die hole is at least 1.2 times a height of the die shoulder in a direction parallel to the axis of the die hole.

(3) In the burring processing method according to the above (1) or (2), when a plate thickness around the prepared hole of the metal component is defined as t, and a height of the curved portion in the direction parallel to the axis of the burring processed portion is defined as h, the following Expression 1 may be satisfied.

$$h/t<0.6 \quad \text{Expression 1}$$

(4) In the burring processing method according to any one of the above (1) to (3), when the plate thickness around the prepared hole of the metal component is defined as t, and a plate thickness of an opening side end portion of the upright portion is defined as $t_b$, the following Expression 2 may be satisfied.

$$t_b/t<0.9 \quad \text{Expression 2}$$

(5) In the burring processing method according to any one of the above (1) to (4), a value obtained by differentiating an expression representing the curve twice may be larger than 0.

(6) A method for manufacturing a burring processed product according to one aspect of the present invention includes a burring processed portion forming process of increasing a diameter of a prepared hole provided in a metal component and bending a part of the metal component to form a burring processed portion including an upright portion and a curved portion, in which, in a cross-section that passes through an axis of the burring processed portion and is parallel to the axis of the buffing processed portion, a cross-sectional shape of the curved portion on an inner surface of the curved portion consists of a curve, and a length of the curved portion in a direction perpendicular to the axis of the burring processed portion is at least 1.2 times a height of the curved portion in a direction parallel to the axis of the burring processed portion.

(7) A method for manufacturing a burring processed product according to one aspect of the present invention includes a buffing processed portion forming process of forming a burring processed portion in a metal component provided with a prepared hole using a mold including a die having a die hole, a holder, and a punch, in which, in the buffing processed portion forming process, the metal component is sandwiched between the die and the holder, the punch is inserted into the die hole along an axis of the die hole to increase a diameter of the prepared hole and to bend a part of the metal component, thereby forming a buffing processed portion including an upright portion and a curved portion, and in a cross-section that passes through the axis of the die hole and is parallel to the axis of the die hole, a cross-sectional shape of a die shoulder consists of a curve, and a length of the die shoulder in a direction perpendicular to the axis of the die hole is at least 1.2 times a height of the die shoulder in a direction parallel to the axis of the die hole.

(8) In the method for manufacturing a burring processed product according to the above (6) or (7), a prepared hole forming process of forming the prepared hole in the metal component may be further provided before the burring processed portion forming process.

(9) In the method for manufacturing a buffing processed product according to any one of the above (6) to (8), when a plate thickness around the prepared hole of the metal component is defined as t, and a height of the curved portion in the direction parallel to the axis of the buffing processed portion is defined as h, the following Expression 1 may be satisfied.

$$h/t<0.6 \quad \text{Expression 1}$$

(10) In the method for manufacturing a buffing processed product according to any one of the above (6) to (9), when a plate thickness around the prepared hole of the metal component is defined as t, and a plate thickness of an opening side end portion of the upright portion is defined as $t_b$, the following Expression 2 may be satisfied.

$$t_b/t<0.9 \quad \text{Expression 2}$$

(11) In the method for manufacturing a burring processed product according to any one of the above (6) to (10), a value obtained by differentiating an expression representing the curve twice may be larger than 0.

(12) A burring processing mold according to one aspect of the present invention is a mold that includes a die having a die hole, a holder holding a workpiece together with the die, and a punch movable relative to the die and the holder, in which, in a cross-section that passes through an axis of the die hole and is parallel to the axis of the die hole, a cross-sectional shape of a die shoulder consists of a curve, and a length of the die shoulder in a direction perpendicular to the axis of the die hole is at least 1.2 times a height of the die shoulder in a direction parallel to the axis of the die hole.

(13) In the burring processing mold according to the above (12), the punch includes a cylindrical portion having a diameter smaller than a diameter of the die hole and the punch is configured to be inserted into the die hole along the axis of the die hole, and when a clearance between the die hole and the cylindrical portion is defined as cl and a height of the die shoulder in a direction parallel to the axis of the die hole in the cross-sectional shape is defined as $h_d$, the following Expression 3 may be satisfied.

$$cl<1.5h_d \quad \text{Expression 3}$$

(14) In the burring processing mold according to the above (12) or (13), a value obtained by differentiating an expression representing the curve twice may be larger than 0.

(15) A burring processing device according to one aspect of the present invention includes the burring processing mold according to any one of the above (12) to (14), in which, the device includes a drive mechanism configured to move the die, the holder, and the punch relative to each other.

(16) A burring processed product according to one aspect of the present invention includes a burring processed portion including an upright portion and a curved portion, in which, in a cross-section that passes through an axis of the buffing processed portion and is parallel to the axis of the burring processed portion, a cross-sectional shape of the curved portion on an inner surface of the curved portion consists of a curve, and a length of the curved portion in a direction perpendicular to the axis of the burring processed portion is at least 1.2 times a height of the curved portion in a direction parallel to the axis of the burring processed portion.

(17) In the burring processed product according to the above (16), when a plate thickness around the curved portion is defined as $t_s$, and a height of the curved portion in the direction parallel to the axis of the burring processed portion is defined as h, the following Expression 4 may be satisfied.

$$h/t_s<0.6 \quad \text{Expression 4}$$

(18) In the burring processed product according to the above (16) or (17), when a plate thickness around the curved portion is defined as $t_s$, and a plate thickness of an opening side end portion of the upright portion is defined as $t_b$, the following Expression 5 may be satisfied.

$$t_b/t_s<0.9 \quad \text{Expression 5}$$

(19) The buffing processed product according to any one of the above (16) to (18) may be any of a lower arm, a trailing arm, and upper arm, which are used in a vehicle.

(20) The buffing processed product according to any one of the above (16) to (18) may be a lower arm used in a vehicle, which further includes a cylindrical portion and a cylindrical flange portion, in which, in a plane that is perpendicular to the axis of the buffing processed portion and passes through a center C in a length direction of the cylindrical portion on an axis of the cylindrical portion, when an intersection between the axis of the burring processed portion and the plane is defined as an intersection A, an intersection between an axis of the cylindrical flange portion and the plane is defined as an intersection B, and the smaller angle between a line segment AB connecting the intersection A to the intersection B and a line segment AC connecting the intersection A to the center C is defined as θ, and in the range of 2θ from the line segment AB to a side on which the center C is located, and in the range of 2θ from the line segment AB to a side opposite to the side on which the center C is located, with the intersection A set as a center, in the cross-section that passes through the axis of the burring processed portion and is parallel to the axis of the buffing processed portion, the cross-sectional shape of the curved portion on the inner surface consists of a curve, and the length of the curved portion in the direction perpendicular to the axis of the burring processed portion is at least 1.2 times the height of the curved portion in the direction parallel to the axis of the burring processed portion.

(21) In the burring processed product according to any one of the above (16) to (20), a value obtained by differentiating an expression representing the curve twice may be larger than 0.

Effects of Invention

According to the present invention, it is possible to provide a burring processing method, a method for manufacturing a burring processed product, a burring processing mold, a burring processing device, and a burring processed product in which generation of cracks in a burring processed portion can be inhibited.

EMBODIMENTS FOR IMPLEMENTING INVENTION

Figure 1:
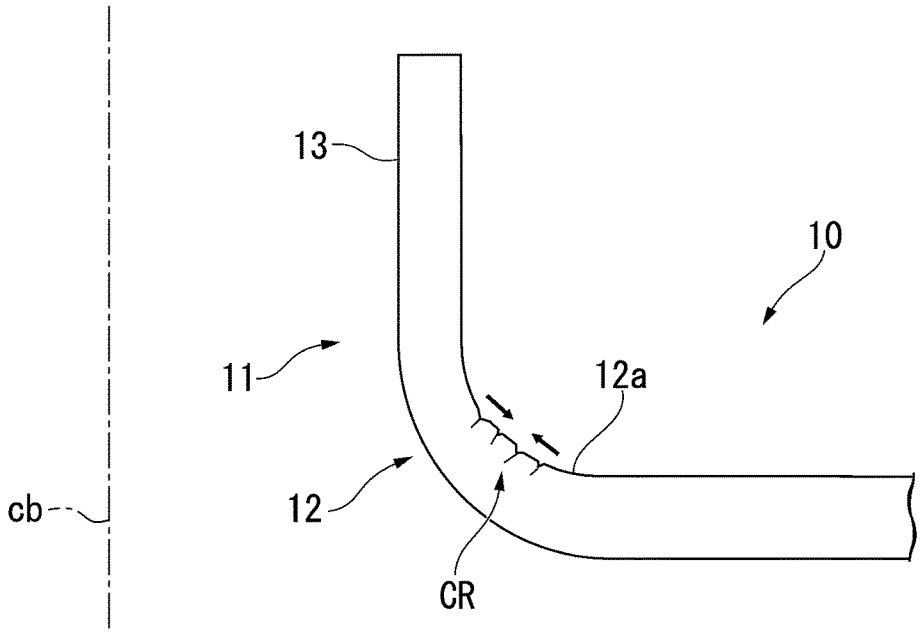
FIG. 1 is a schematic cross-sectional view of a burring processed portion for showing a state of compression strain and in-bend cracks in a curved portion of the buffing processed portion.

The present inventors have found that, in a forming process of burring processing, unevenness is generated due to compressive strain generated on an inner surface of a curved portion, and thus the above-mentioned in-bend cracks are generated. FIG. 1 is a schematic cross-sectional view of a burring processed portion for showing a state of compressive strain and in-bend cracks in a curved portion of a burring processed portion. FIG. 1 shows a cross-section of a burring processed product 10 in a plane that passes through an axis cb of a burring processed portion 11 and is parallel to the axis cb and shows only one side of the burring processed portion 11 centered on the axis cb. As shown in FIG. 1, the burring processed portion 11 of the buffing processed product 10 has a curved portion 12 and an upright portion 13. In the forming process, compressive strain is generated on an inner surface 12*a* of the curved portion 12 in directions of arrows in the figure, and in-bend cracks CR are generated starting from unevenness caused by the compression strain.

In addition, the present inventors have also found that such unevenness on the surface is likely to occur in a case in which a workpiece and a mold do not come into contact with each other during forming. In particular, in a case in which a radius of curvature of the curved portion is small, generation of the in-bend cracks tend to be remarkable.

Here, as a technique of burring processing, in an ironing burring processing method as described in Patent Document 2, when buffing processing is performed, a clearance between a cylindrical punch for increasing a diameter of a prepared hole and a die having a shape corresponding to the punch is made smaller than a plate thickness around the prepared hole. For that reason, forming proceeds while a workpiece and a mold are in good contact with each other. Thus, the present inventors have focused on the fact that in the ironing burring processing method, in-bend cracks are relatively unlikely to be generated.

On the other hand, the present inventors have found that, even if an ironing burring processing method is used, in a case in which a radius of curvature of a curved portion of a burring processed portion is extremely small (about 1.0 mm) with respect to a plate thickness of a workpiece and the workpiece is a high-strength material, in-bend cracks may be generated, and these in-bend cracks are generated due to a portion at which a material rises on an inner surface of the curved portion in a forming process.

Figure 2:
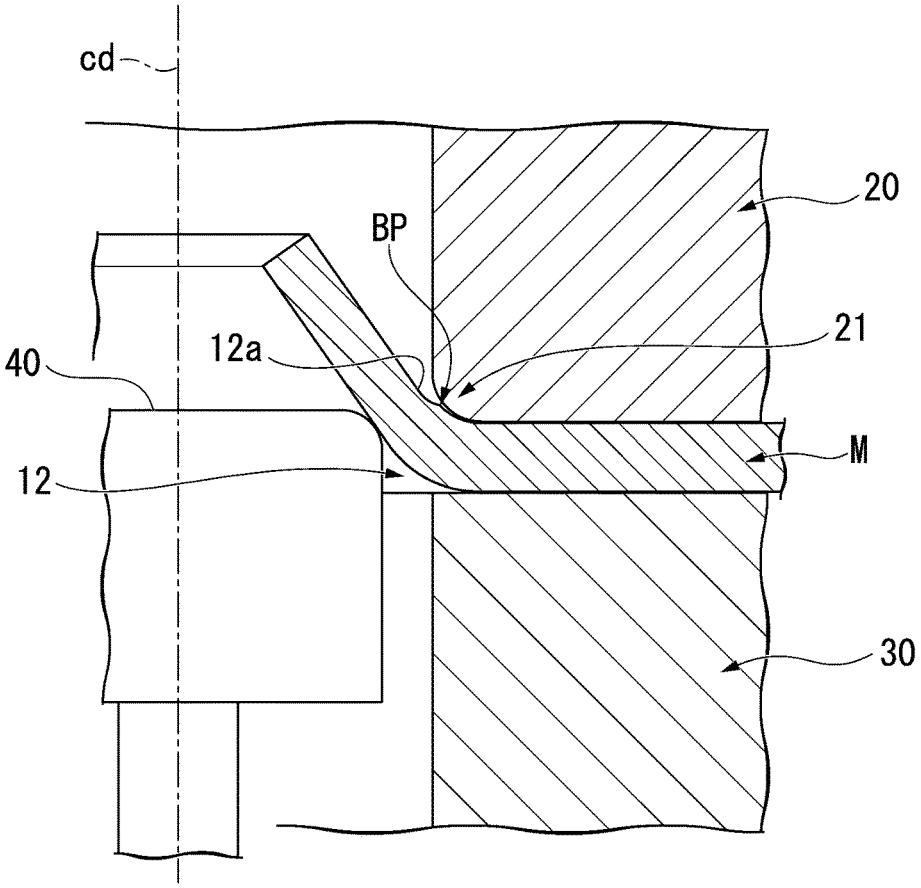
FIG. 2 is a schematic cross-sectional view of the burring processed portion for describing a state in which a workpiece rises in a forming process of burring processing.

FIG. 2 shows a schematic cross-sectional view of the burring processed portion for describing a state in which a workpiece rises in the forming process of the burring processing. FIG. 2 shows a state in which a workpiece M is being sandwiched between a die 20 and a holder 30 in the forming process of the burring processing, and the workpiece M is being deformed by a punch 40 to form the curved portion 12. As illustrated in FIG. 2, in a case in which a radius of curvature of a die shoulder 21 corresponding to a radius of curvature of the curved portion of the burring processed portion is small, particularly in an initial stage of the forming process, a raised portion BP is generated on the inner surface 12*a* of the curved portion 12 that comes into contact with the die shoulder 21. Since compressive strain is generated in such a raised portion BP, it may cause the in-bend cracks as described above. Thus, the present inventors have sought to investigate a method for inhibiting such rising of the material, which causes the compression strain.

Further, the technique of Patent Document 1 is a technique of inhibiting concentration of the compressive stress locally on the inner surface of the bend of the curved portion of the burring processed portion during a coining process. On the other hand, the present invention has focused on inhibiting in-bend cracks in the forming process of the burring processing and is different from the technique of Patent Document 1 in a forming method of the buffing processed portion.

Although embodiments of the present invention will be described below with reference to examples, it is obvious that the present invention is not limited to the examples described below. In the following description, specific numerical values and materials are exemplary examples, but other numerical values and materials may be applied as long as effects of the present invention can be obtained. In addition, respective components of the following embodiments can be combined with each other.

First Embodiment

The burring processing method according to the present embodiment is a method of increasing a diameter of a prepared hole provided in a metal component and bending a part of the metal component to form a buffing processed portion including an upright portion and a curved portion. In the burring processing method, in a cross-section that passes through an axis of the burring processed portion and is parallel to the axis of the burring processed portion, a cross-sectional shape of the curved portion on an inner surface thereof consists of a curve, and a length of the curved portion in a direction perpendicular to the axis of the burring processed portion is at least 1.2 times a height thereof in the direction parallel to the axis of the buffing processed portion.

By using the burring processing method having the above configuration, generation of the in-bend cracks in the curved portion of the buffing processed portion can be inhibited.

First, the burring processing method will be described. FIGS. 3(A) to 3(C) are schematic plan views for describing the forming process of the buffing processing and are plan views seen in a direction intersecting a plate surface of a metal component 1. FIG. 3(A) shows the metal component 1 having the prepared hole 2. FIG. 3(B) shows a state in which a circumferential portion of the prepared hole 2 is deformed and a diameter of the prepared hole 2 is increased. FIG. 3(C) shows a burring processed product 100 in which the burring processing has been completed. FIGS. 4(A) to 4(C) are schematic cross-sectional views for respectively describing the forming process of the buffing processing in FIGS. 3(A) to 3(C) and show a cross-section that passes through a center of the prepared hole 2, passes through an axis ca orthogonal to a plate surface of the metal component 1 or an axis cb of a formed buffing processed portion 110, and is parallel to these axes. Also, in general, the axis ca that passes through the center of the prepared hole 2 and is orthogonal to the plate surface of the metal component 1 and the axis cb of the buffing processed portion 110 are aligned with each other. In the present embodiment, the metal component 1 will be described as a metal plate.

Figure 3:
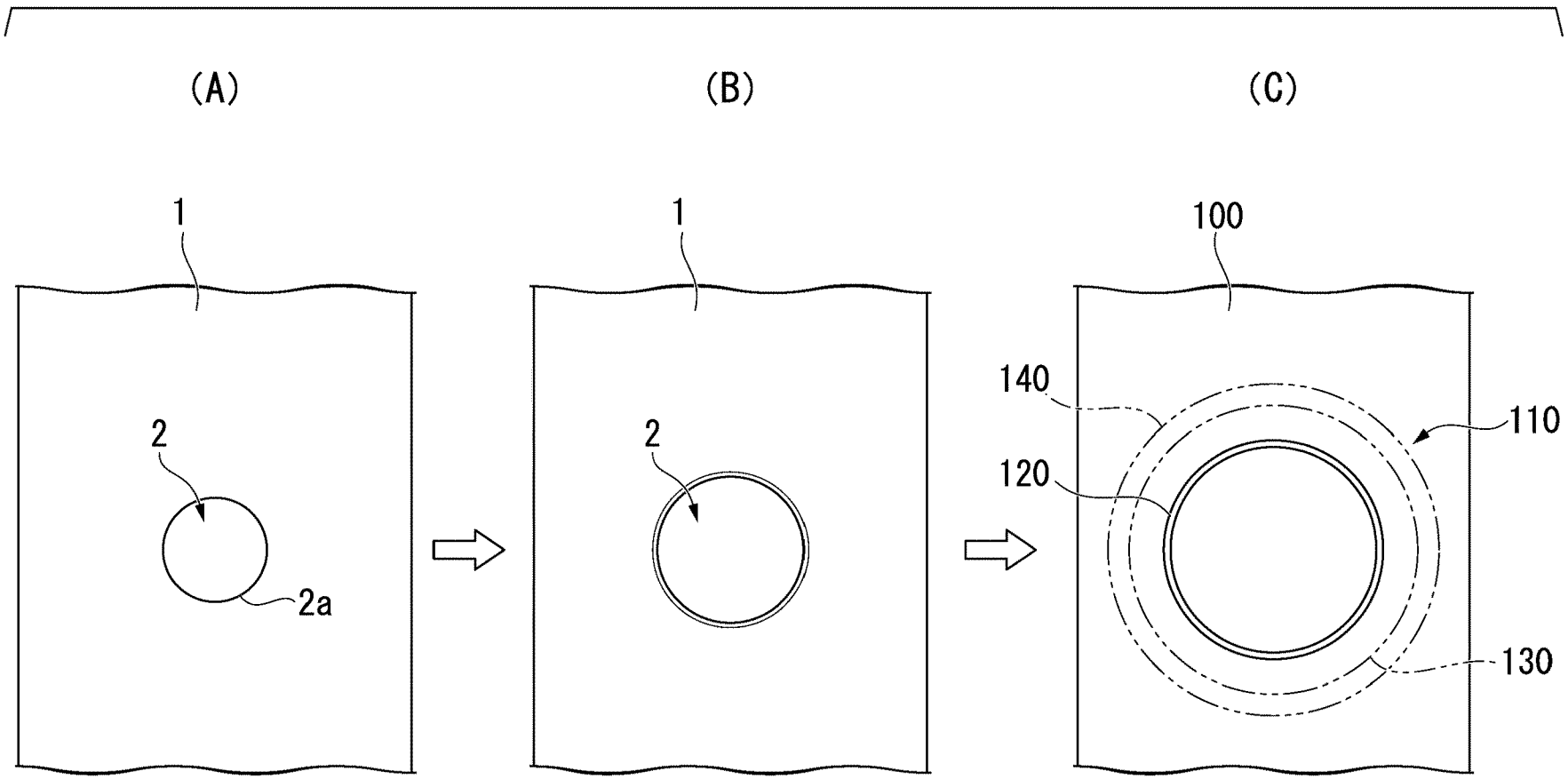
FIGS. 3(A) to 3(C) are schematic plan views for describing the forming process of burring processing.
Figure 4:
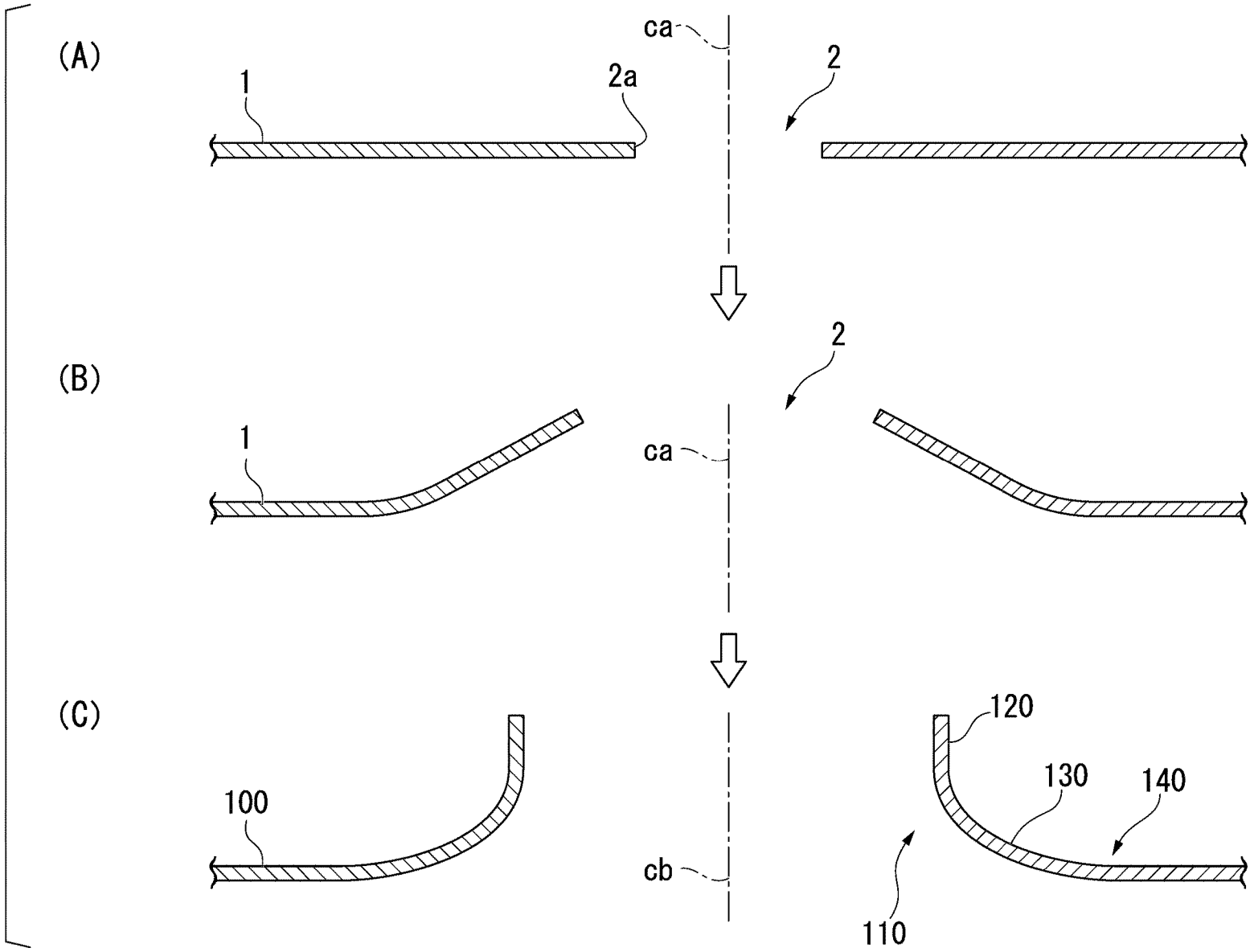
FIGS. 4(A) to 4(C) are schematic cross-sectional views for describing the forming process of burring processing in FIGS. 3(A) to 3(C), respectively.

In the buffing processing method, as shown in FIGS. 3 and 4, the diameter of the prepared hole 2 provided in the metal component 1 is increased, and a part of the metal component 1 is bent to form the burring processed portion 110 including an upright portion 120 and a curved portion 130. There is a circumferential region 140 around the curved portion 130.

Figure 5:
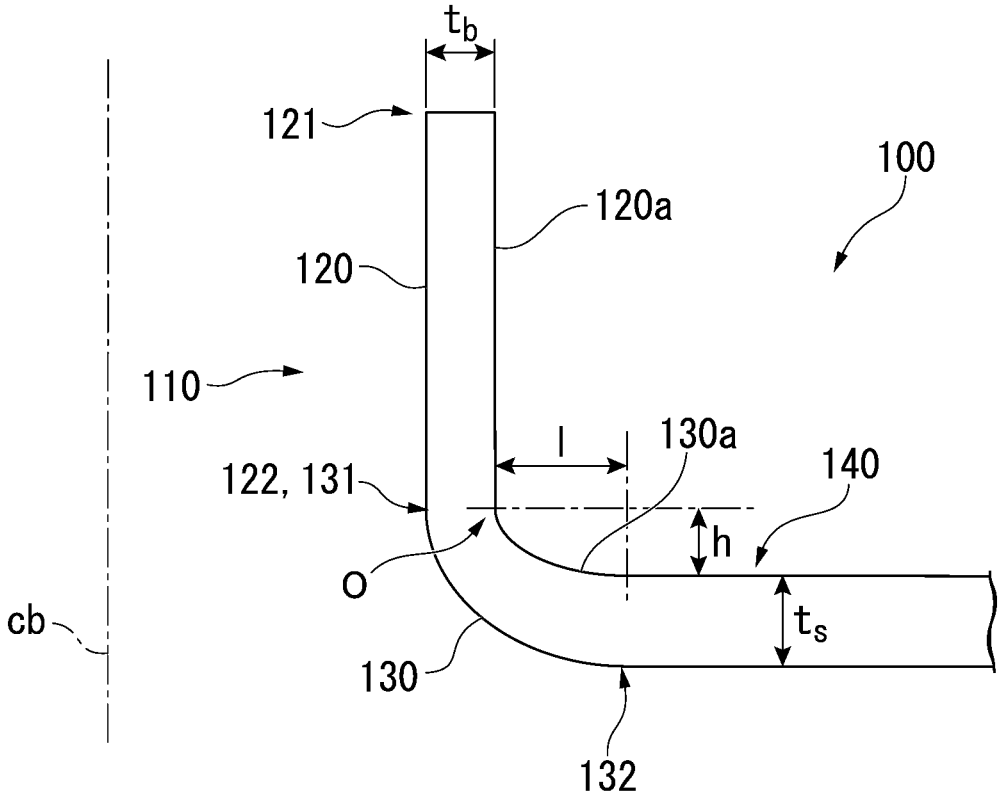
FIG. 5 is a schematic cross-sectional view of a buffing processed product for describing a burring processed product according to a first embodiment.

FIG. 5 is a diagram for describing the burring processed product according to the present embodiment and is a cross-sectional view of the buffing processed product 100 in the cross-section that passes through the axis cb of the burring processed portion 110 and is parallel to the axis cb of the buffing processed portion 110. FIG. 5 shows only one side of the buffing processed portion 110 centered on the axis cb. As shown in FIG. 5, the burring processed portion 110 according to the present embodiment includes the cylindrical upright portion 120 and the curved portion 130. The upright portion 120 is connected to the curved portion 130 at a connecting end portion 122 on a side opposite to an opening end portion 121 of the upright portion 120.

The curved portion 130 is connected to the connecting end portion 122 of the upright portion 120 at a tip portion 131 thereof and is connected to a circumferential region 140 of the burring processed product 100 via a base end portion 132 on a side opposite to the tip portion 131. The connecting end portion 122 and the tip portion 131 may be at the same place. A diameter of the curved portion 130 is increased from the tip portion 131 toward the base end portion 132. The curved portion 130 is smoothly bent in the cross-section that passes through the axis cb of the buffing processed portion 110 and is parallel to the axis cb of the burring processed portion 110. The axis cb of the burring processed portion 110 is an axis that passes through an axis of the cylindrical upright portion 120 in a length direction thereof.

The circumferential region 140 is a region surrounding the curved portion 130 in the burring processed product 100 and is a region connected to the base end portion 132 of the curved portion 130. Although it also depends on a shape of the burring processed product 100, the circumferential region 140 preferably has a width of about 1 to 10 mm in a radial direction of the burring processed portion 110 in a plane orthogonal to the axis cb of the burring processed portion 110.

In the buffing processed product 100 in which the buffing processed portion 110 according to the present embodiment is formed, in the cross-section that passes through the axis cb of the burring processed portion 110 and is parallel to the axis cb of the burring processed portion 110, a cross-sectional shape of the curved portion 130 on an inner surface 130*a* thereof consists of a curve, and a length l of the curved portion 130 on the inner surface 130*a* in a direction perpendicular to the axis cb of the burring processed portion 110 is at least 1.2 times a height h thereof in a direction parallel to the axis cb of the buffing processed portion 110. With such a configuration, generation of the in-bend cracks on the inner surface of the curved portion can be inhibited. More specifically, by setting the length l at least 1.2 times the height h, cracking depths of the in-bend cracks can be reduced.

In the cross-section that passes through the axis cb of the burring processed portion 110 and is parallel to the axis cb of the burring processed portion 110, the length l of the curved portion 130 on the inner surface 130*a* in the direction perpendicular to the axis cb of the burring processed portion 110 is preferably at least 1.4 times, and more preferably at least 1.6 times the height h in the direction parallel to the axis cb of the burring processed portion 110. With such a configuration, compressive strain can be reduced, generation of the in-bend cracks on the inner surface 130*a* of the curved portion 130 can be inhibited, and the cracking depths can be significantly reduced.

The length l is a distance from a contact point (an origin O, which will be described later) between an outer circumferential surface 120*a* of the upright portion 120 and the inner surface 130*a* of the curved portion 130 to the base end portion 132 of the curved portion 130 and is a distance in the direction perpendicular to the axis cb in the cross-section that passes through the axis cb of the burring processed portion 110 and is parallel to the axis cb of the burring processed portion 110. The length l of the curved portion 130 is preferably 0.8 to 5.0 mm, and more preferably 1.0 to 2.5 mm.

The height h is a distance from the contact point (origin O, which will be described later) between the outer circumferential surface 120*a* of the upright portion 120 and the inner surface 130*a* of the curved portion 130 to the inner surface 130*a* of the base end portion 132 of the curved portion 130 and is a distance in the direction parallel to the axis cb in the cross-section that passes through the axis cb of the burring processed portion 110 and is parallel to the axis cb of the burring processed portion 110. The height h of the curved portion 130 is preferably 0.5 to 3.0 mm, and more preferably 0.8 to 2.0 mm.

In addition, in the cross-section that passes through the axis cb of the burring processed portion 110 and is parallel to the axis cb of the burring processed portion 110, the length l of the curved portion 130 on the inner surface 130*a* in the direction perpendicular to the axis cb of the buffing processed portion 110 is preferably at most 3.0 times the height h in the direction parallel to the axis cb of the burring processed portion 110. By setting the length l at most 3.0 times the height h, it is possible to avoid interference with other portions of the buffing processed portion and efficiently obtain the effect of inhibiting generation of cracks.

Figure 6:
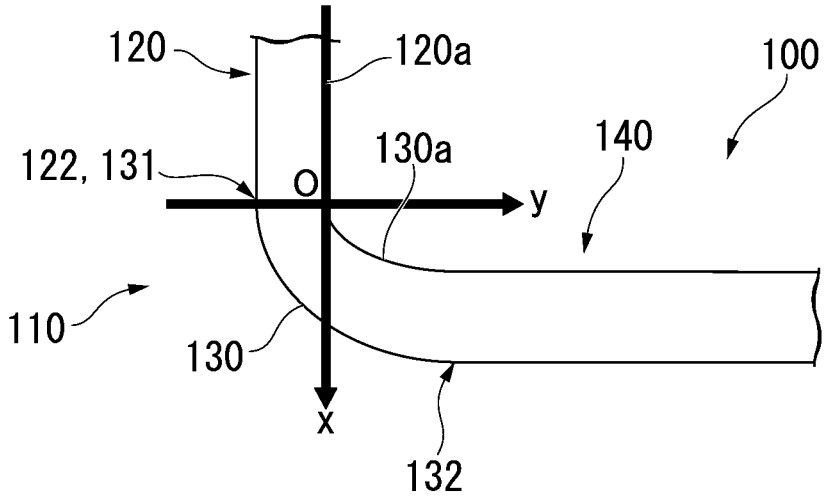
FIG. 6 is a schematic cross-sectional view of a burring processed product for describing xy coordinates for defining a cross-sectional shape of a curved portion on an inner surface thereof.

The curve of the cross-sectional shape of the curved portion 130 on the inner surface 130*a* can be defined as follows. As shown in FIG. 6, in the cross-section that passes through the axis cb of the burring processed portion 110 and is parallel to the axis cb of the buffing processed portion 110, a direction parallel to the axis cb is defined as an x axis, and a direction perpendicular to the axis cb in the cross-section is defined as a y axis. In addition, the contact point between the outer circumferential surface 120*a* of the upright portion 120 and the inner surface 130*a* of the curved portion 130 is defined as the origin O, and a side on which the curved portion 130 is located is defined as a positive region. A curve in xy coordinates can be defined as a curve drawn by the cross-sectional shape of the curved portion 130 on the inner surface 130*a*.

The cross-sectional shape of the inner surface 130*a* consists of a curve in the cross-section that passes through the axis cb of the burring processed portion 110 and is parallel to the axis cb of the buffing processed portion 110 and does not include a straight line. Here, in a case in which there is a straight line portion in the cross-sectional shape, a value obtained by differentiating x twice (a second derivative) becomes 0 in the straight line portion when an expression representing the cross-sectional shape of the inner surface 130*a* is expressed by $y=f(x)$ in the above xy coordinates.

Further, the cross-sectional shape of the inner surface 130*a* may be a cross-sectional shape in which the value obtained by differentiating x twice (second derivative) is larger than 0 when an expression representing the cross-sectional shape of the inner surface 130*a* is expressed by $y=f(x)$ in the above xy coordinates. That is, in the above curve drawn by the cross-sectional shape of the inner surface 130*a*, the value obtained by differentiating the expression representing the curve twice in the above xy coordinates may be larger than 0. The fact that the value obtained by differentiating the expression representing the curve twice with x becomes larger than 0 means that an overall shape of the curve is convex toward the axis cb side of the burring processed portion 110 in the range of $h \geq x \geq 0$.

Further, a part of the above curve drawn by the cross-sectional shape of the inner surface 130*a* may be a part of a curve represented by a quadratic function or a curve represented by a trigonometric function. By forming a part of the above curve drawn by the cross-sectional shape of the inner surface 130*a* as a part of the curve represented by a quadratic function or a trigonometric function, generation of the in-bend cracks can be further inhibited. Examples of curves represented by quadratic or trigonometric functions include curves such as ellipses, parabolas, sine curves, and cosine curves.

In a case in which a part of the above curve drawn by the cross-sectional shape of the inner surface 130*a* is a part of an ellipse, the curve representing the ellipse can be represented by $x^2/a^2+(y-b)^2/b^2=1$ in the above xy coordinates. Here, a is an axis of the ellipse in the x axis direction, and b is an axis of the ellipse in the y axis direction. The axis a in the x direction of the ellipse may be equal to the height h of the curved portion, and the axis b in the y direction of the ellipse may be equal to the length l of the curved portion, and in that case, this curve is conditioned on satisfying $b/a>1.2$.

Figure 7:
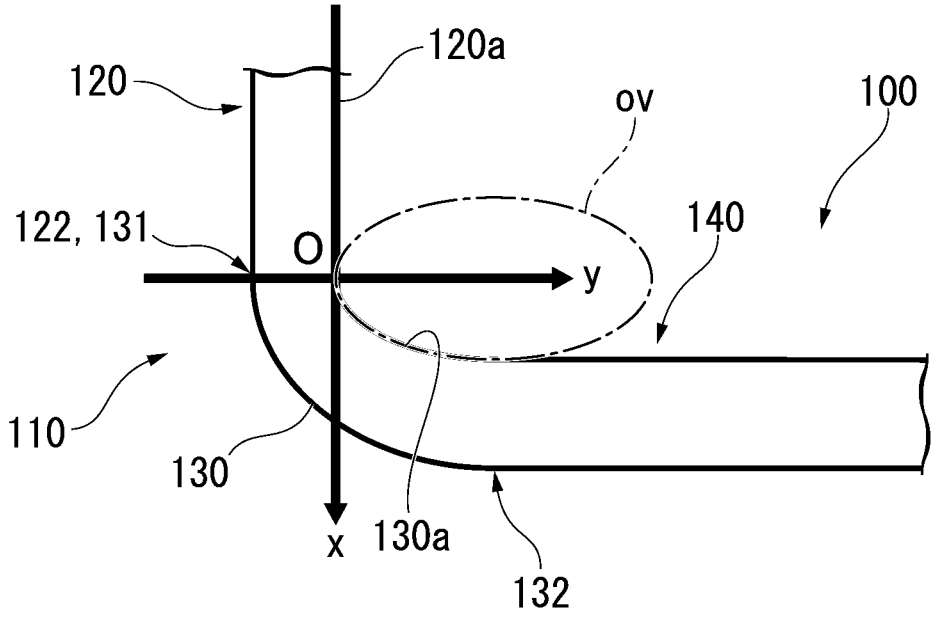
FIG. 7 is a schematic cross-sectional view of the burring processed product for describing coordinates for defining the curved portion and is a diagram showing an example in which a part of the cross-sectional shape of the curved portion is a part of an ellipse.

FIG. 7 shows an example of a form in which a part of the curve drawn by the cross-sectional shape of the inner surface 130*a* is a part of an ellipse ov in the cross-section that passes through the axis cb of the burring processed portion 110 and is parallel to the axis cb of the burring processed portion 110.

When a part of the above curve drawn by the cross-sectional shape of the inner surface 130*a* is a part of a parabola, the curve representing the parabola can be represented by $y=ax^2$ in the above xy coordinates. In this case, a is conditioned on satisfying $a<1/h$.

Figure 8:
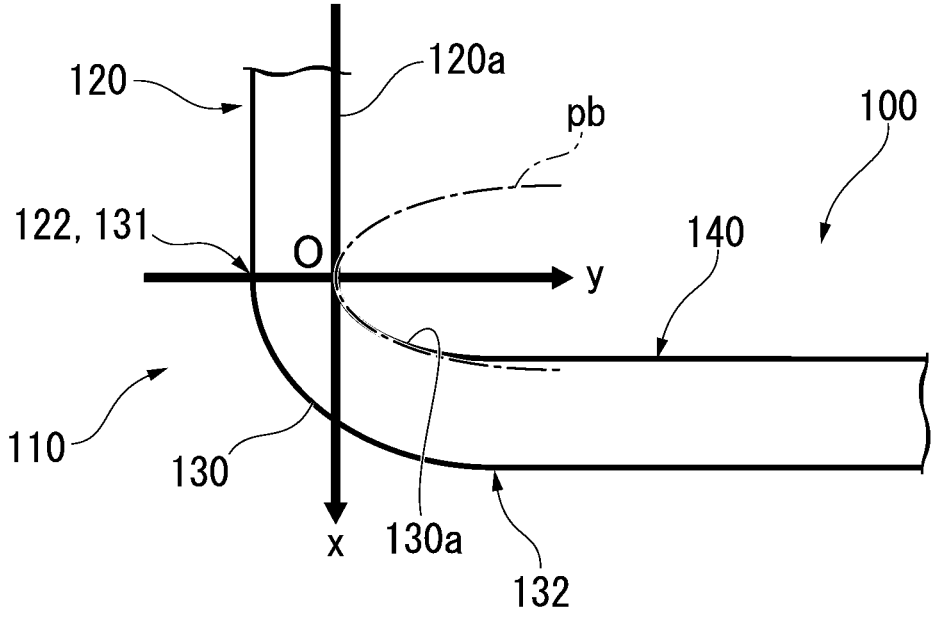
FIG. 8 is a schematic cross-sectional view of the buffing processed product for describing coordinates for defining the curved portion and is a diagram showing an example in which a part of the cross-sectional shape of the curved portion is a part of a parabola.

FIG. 8 shows an example of a form in which a part of the above curve drawn by the cross-sectional shape of the inner surface 130*a* is a part of a parabola pb in the cross-section that passes through the axis cb of the burring processed portion 110 and is parallel to the axis cb of the burring processed portion 110.

In a case in which a part of the above curve drawn by the cross-sectional shape of the inner surface 130*a* is a part of a sine curve, the curve representing the sine curve can be represented by $y=\sin(ax-\pi/2)+1$ in the above xy coordinates. In this case, a is conditioned on satisfying $h>\sin(ah-\pi/2)+1$.

Figure 9:
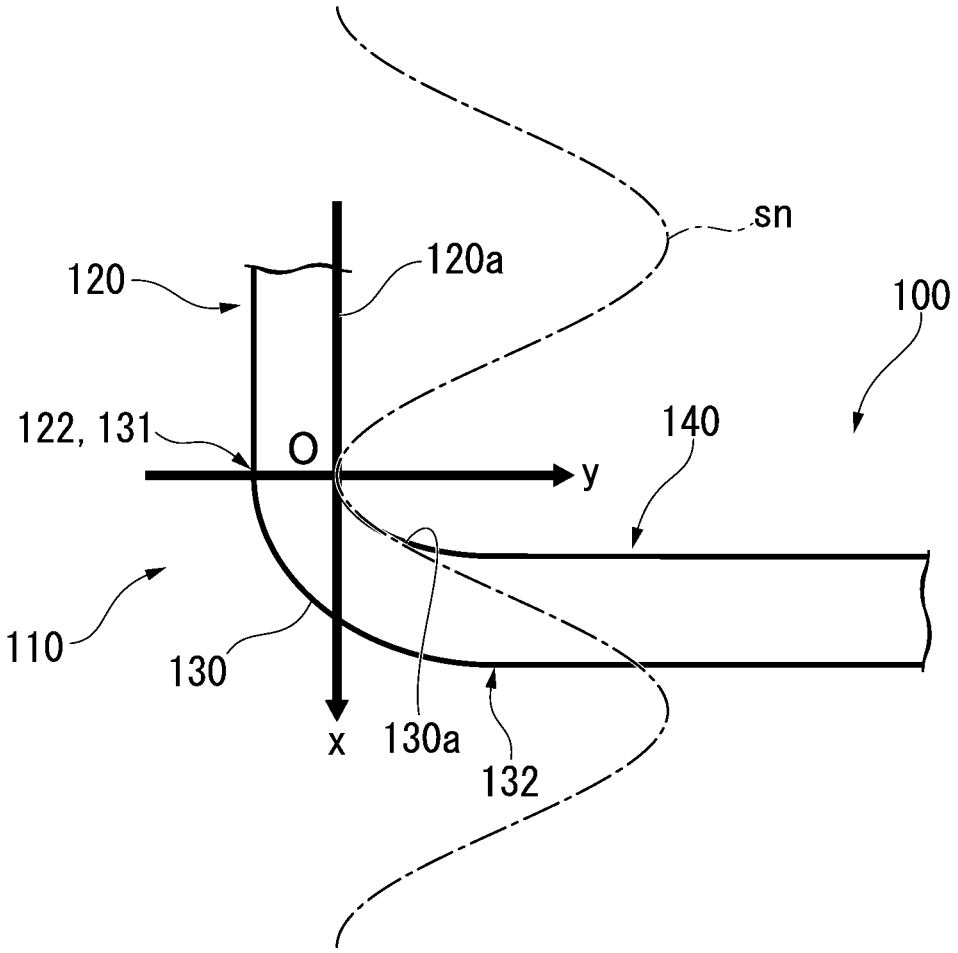
FIG. 9 is a schematic cross-sectional view of the burring processed product for describing coordinates for defining the curved portion and is a diagram showing an example in which a part of the cross-sectional shape of the curved portion is a part of a sine curve.

FIG. 9 shows an example of a form in which a part of the above curve drawn by the cross-sectional shape of the inner surface 130*a* is a part of a sine curve sn in the cross-section that passes through the axis cb of the burring processed portion 110 and is parallel to the axis cb of the burring processed portion 110.

The cross-sectional shape of the inner surface 130*a* from the origin O serving as a starting point to the base end portion 132 of the curved portion 130 (the entire region of the curved portion 130) may have a curve represented by a quadratic function or a trigonometric function as described above. Alternatively, the cross-sectional shape of the inner surface 130*a* may be a shape obtained by combining a curve represented by a quadratic function or trigonometric function starting from the origin O serving as a starting point and a smooth curve that is connected to the above curve and extends to the base end portion 132.

A shape of the burring processed product 100 is measured using a contact type shape measuring machine. For example, in the case of measuring the inner surface 130*a* of the curved portion 130 of the burring processed portion 110, shape data is measured and acquired in the direction perpendicular to the axis cb of the burring processed portion 110 using a contact type shape measuring machine having a probe diameter of 2 mm A data collection interval is set to 0.05 mm pitch in the direction parallel to the axis cb of the burring processed portion 110.

The curve of the cross-sectional shape on the inner surface 130*a* of the curved portion 130 is obtained by approximating the above shape data to the curve using the least squares method. The approximated curve is a quadratic function or trigonometric function as described above. For obtaining the expression of the curve, a function with a coefficient of determination of at least 0.9 is used. Specifically, the shape data measured in the process of obtaining the expression of the curve is approximated to several curves, and among them, one having a coefficient of determination of at least 0.9 and having the largest coefficient of determination is defined as the curve of the cross-sectional shape. Here, in a case in which the coefficient of determination does not exceed 0.9, the curve may be configured of a plurality of curves. For that reason, an approximating section may be narrowed so that the coefficient of determination is at least 0.9. In addition, in determining whether or not the cross-sectional shape includes a straight line, in a case in which change rates of inclinations of adjacent straight lines are within plus or minus 2% for 3 or more consecutive sections when straight lines determined by the least squares method are sequentially created using five adjacent measurement points, the sections are determined to be a straight line.

Further, in a circumferential direction of the burring processed portion, a range in which the cross-sectional shape of the inner surface of the curved portion has the above curve may be all range in a circumferential direction of the curved portion, or may be a part thereof. For example, such a curved shape may be formed only in a range in which a load is intensely applied when the burring processed product is deformed by applying the load. Also, the length l of the curved portion 130 may be at most 5.0 times or at most 2.0 times the height h.

Second Embodiment

The method for manufacturing a burring processed product according to the present embodiment includes a burring processed portion forming process of increasing a diameter of a prepared hole provided in a metal component and bending a part of the metal component to form a burring processed portion including an upright portion and a curved portion. In the method for manufacturing a burring processed product, in a cross-section that passes through an axis of the burring processed portion and is parallel to the axis of the burring processed portion, a cross-sectional shape of the curved portion on an inner surface thereof consists of a curve, and a length of the curved portion in a direction perpendicular to the axis of the burring processed portion is at least 1.2 times a height thereof in a direction parallel to the axis of the burring processed portion.

By using the method for manufacturing a burring processed product having the above configuration, generation of in-bend cracks in the curved portion of the burring processed portion of the burring processed product can be inhibited.

In the buffing processed portion forming process of the method for manufacturing a burring processed product according to the present embodiment, the burring processing method described in the first embodiment can be preferably used. Also, in the method for manufacturing a burring processed product according to the present embodiment, since each configuration of the first embodiment can be adopted, descriptions thereof will be omitted.

In the method for manufacturing a burring processed product according to the present embodiment, before the burring processed portion forming process, a prepared hole forming process for forming the prepared hole in the metal component may be further provided.

Next, an embodiment of the burring processing method using a mold will be described.

Third Embodiment

A burring processing method according to the present embodiment is a method for forming a burring processed portion on a metal component provided with a prepared hole using a mold including a die having a die hole, a holder, and a punch. In the burring processing method, the metal component is sandwiched between the die and the holder, and the punch is inserted into the die hole along an axis of the die hole to increase a diameter of the prepared hole and to bend a part of the metal component, thereby forming the burring processed portion including an upright portion and a curved portion. In the burring processing method, in a cross-section that passes through the axis of the die hole and is parallel to the axis of the die hole, a cross-sectional shape of a die shoulder consists of a curve, and a length thereof in a direction perpendicular to the axis of the die hole is at least 1.2 times a height thereof in a direction parallel to the axis of the die hole.

By using the burring processing method having the above configuration, generation of in-bend cracks in the curved portion of the burring processed portion.

Figure 10:
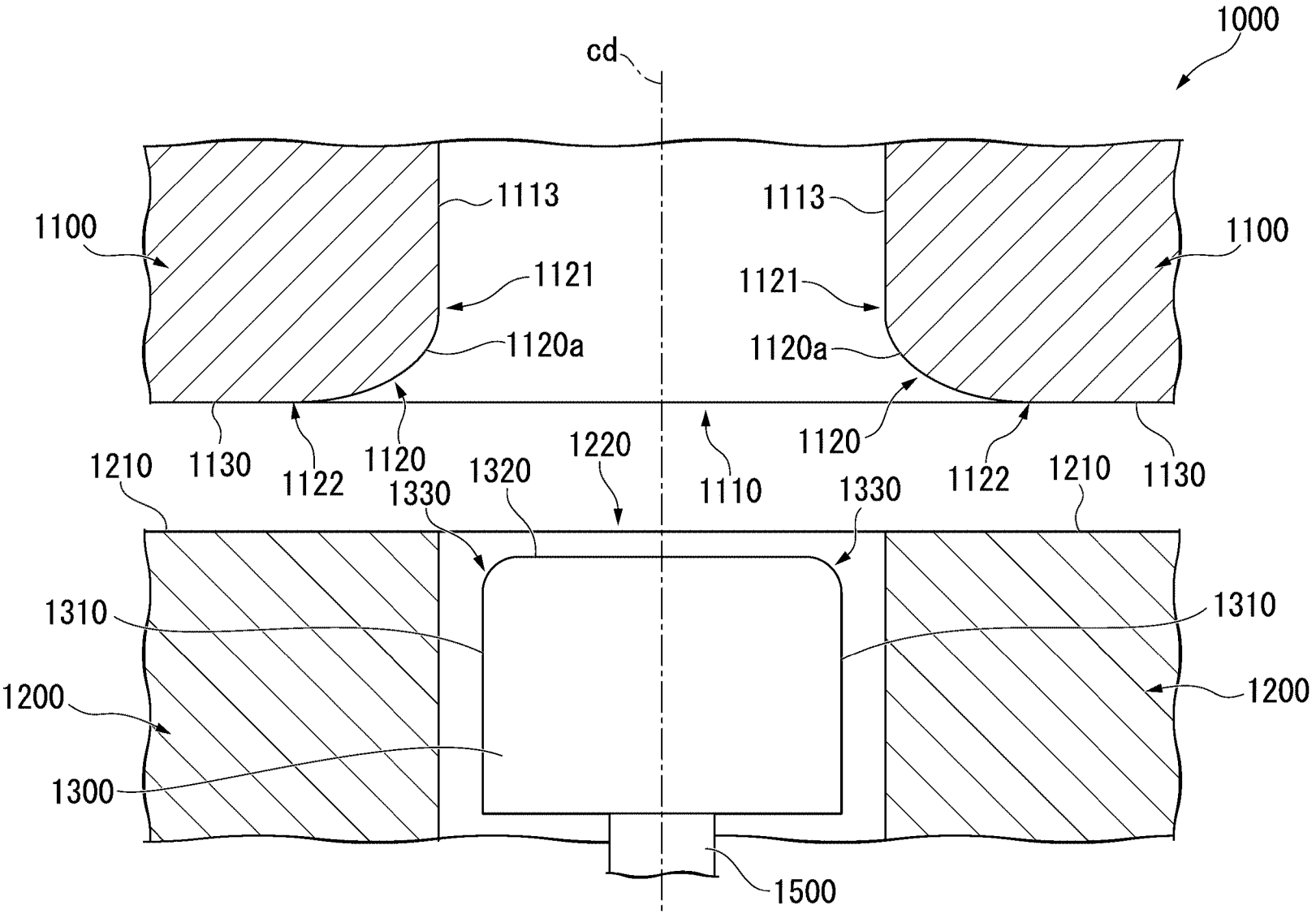
FIG. 10 is a schematic cross-sectional view of a mold for describing a mold according to a third embodiment.

FIG. 10 is a schematic cross-sectional view for describing the mold used in the burring processing method of the present embodiment. This cross-sectional view is a cross-sectional view that passes through the axis of the die hole and is parallel to the axis of the die hole. As shown in FIG. 10, a mold 1000 includes a die 1100, a holder 1200, and a punch 1300.

The die 1100 has a die hole 1110 having a predetermined depth. The die hole 1110 has a substantially cylindrical inner circumferential surface shape, and a cylindrical inner circumferential surface 1113 of the die hole 1110 and a die pressing surface 1130 are connected to each other via a die shoulder 1120. The die 1100 may be movable relative to the holder 1200 by a drive mechanism (not shown).

A surface 1120*a* of the die shoulder 1120 is connected to the cylindrical inner circumferential surface 1113 at a tip portion 1121 and is connected to the die pressing surface 1130 via a base end portion 1122 on a side opposite to the tip portion 1121. A diameter of the surface 1120*a* of the die shoulder 1120 is increased from the tip portion 1121 toward the base end portion 1122. The surface 1120*a* of the die shoulder 1120 is smoothly curved in a cross-section that passes through an axis cd of the die hole 1110 and is parallel to the axis cd of the die hole 1110. A cross-sectional shape of the die shoulder 1120 means a shape of the surface 1120*a* of the die shoulder 1120 in the cross-section that passes through the axis cd of the die hole 1110 and is parallel to the axis cd of the die hole 1110. The axis cd of the die hole 1110 is an axis that passes through an axis line of the cylindrical inner circumferential surface 1113 in a height direction thereof.

The holder 1200 has a holder pressing surface 1210, and a workpiece is sandwiched between the holder pressing surface 1210 and the die pressing surface 1130. The holder 1200 has a holder hole 1220 corresponding to an outer circumferential shape of the punch 1300, and the punch 1300 is disposed to be movable relative to the holder 1200 along an axis of the holder hole 1220. The die 1100 and the holder 1200 may be disposed such that the axis of the die hole 1110 and the axis of the holder hole 1220 coincide with each other. The holder 1200 may be movable relative to the die 1100 by a drive mechanism (not shown).

The punch 1300 has a substantially cylindrical shape, and has a side circumferential surface 1310 and a punch surface 1320. The side circumferential surface 1310 and the punch surface 1320 are connected to each other via a ridge line portion 1330. The ridge line portion 1330 of the punch 1300 may have a radius of curvature (a punch shoulder R) of, for example, 5 to 50 mm not to cause local contact with the workpiece in a cross-sectional view orthogonal to an extending direction of the ridge line portion 1330 at each position along the extending direction of the ridge line portion 1330.

The punch 1300 is movable relative to the die 1100 and the holder 1200 by a drive mechanism 1500. Further, the punch 1300 is movable along the axis of the die hole 1110 inside the die hole 1110.

In order to make a plate thickness of the upright portion of the burring processed portion uniform in the circumferential direction, an axis of the punch 1300 and the axis of the die hole 1110 are preferably disposed to coincide with each other.

Figure 11:
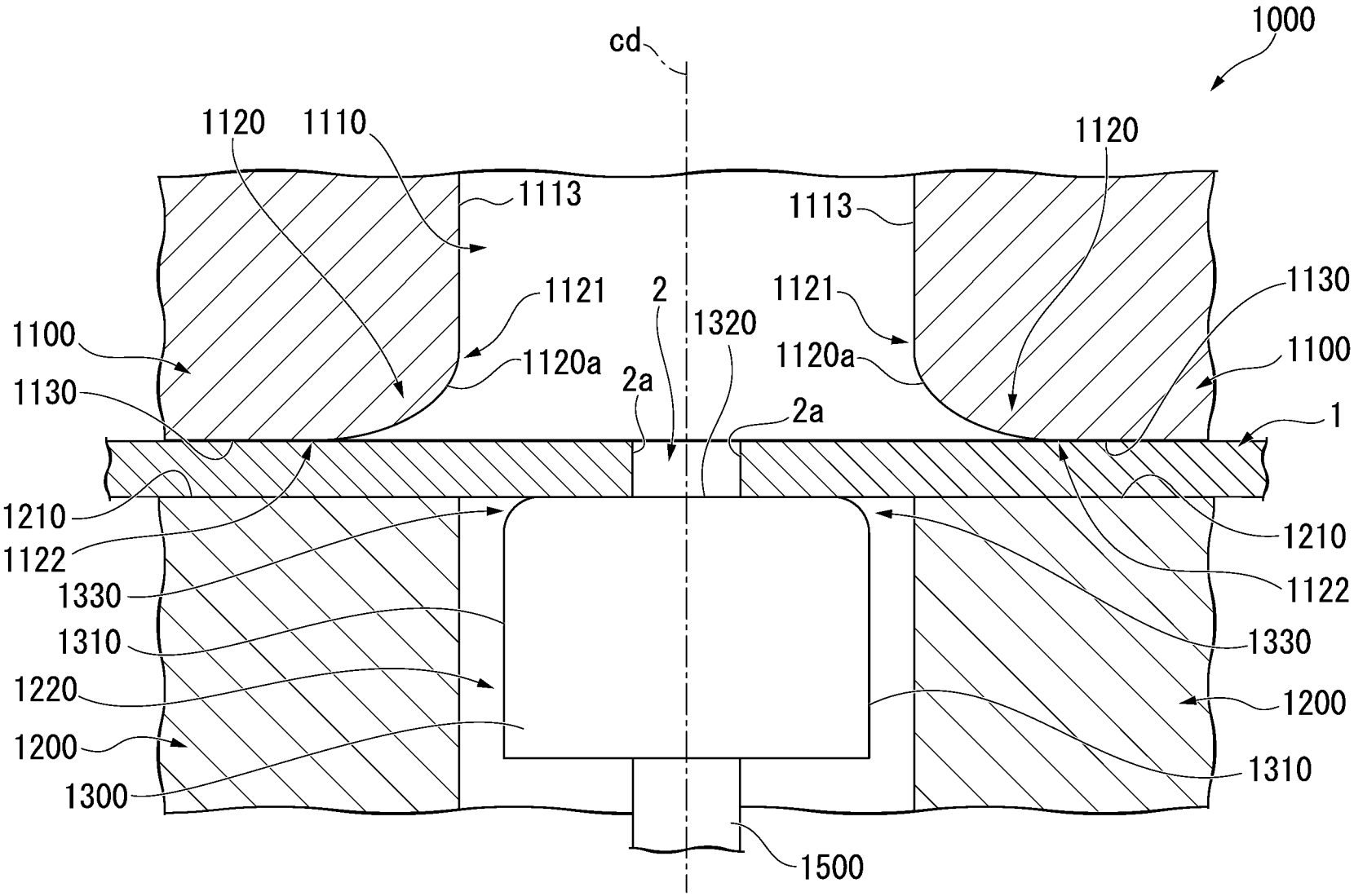
FIG. 11 is a schematic cross-sectional view for describing a burring processing method according to a third embodiment and is a diagram showing a state in which a workpiece is sandwiched between a die and a holder.

FIG. 11 shows a state in which a workpiece 1 (metal component) is sandwiched between the die 1100 and the holder 1200. In this state, as shown in FIG. 11, the punch 1300 may be housed inside the holder hole 1220 of the holder 1200.

Figure 12:
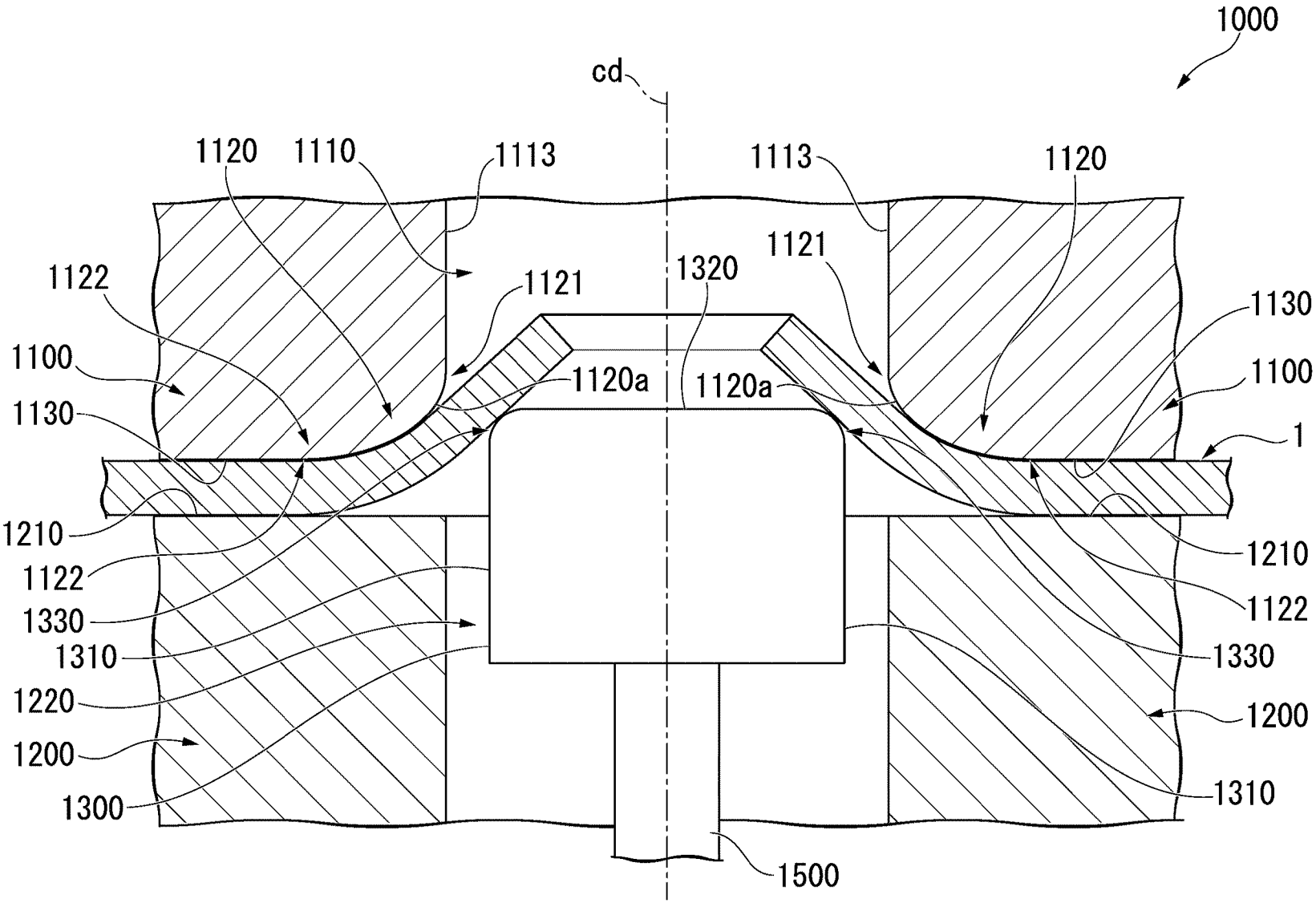
FIG. 12 is a schematic cross-sectional view for describing the buffing processing method according to the third embodiment and is a diagram showing a state in which the workpiece is deformed to the die side by a punch.

FIG. 12 shows a state in which the punch 1300 is moved relative to the die 1100 in a direction from the holder 1200 to the die 1100 along the axis of the die hole 1110. As shown in FIG. 12, the workpiece 1 is pressed into the die hole 1110 while being deformed by the punch 1300. Further, a diameter of the prepared hole 2 of the workpiece 1 is increased due to this deformation.

Figure 13:
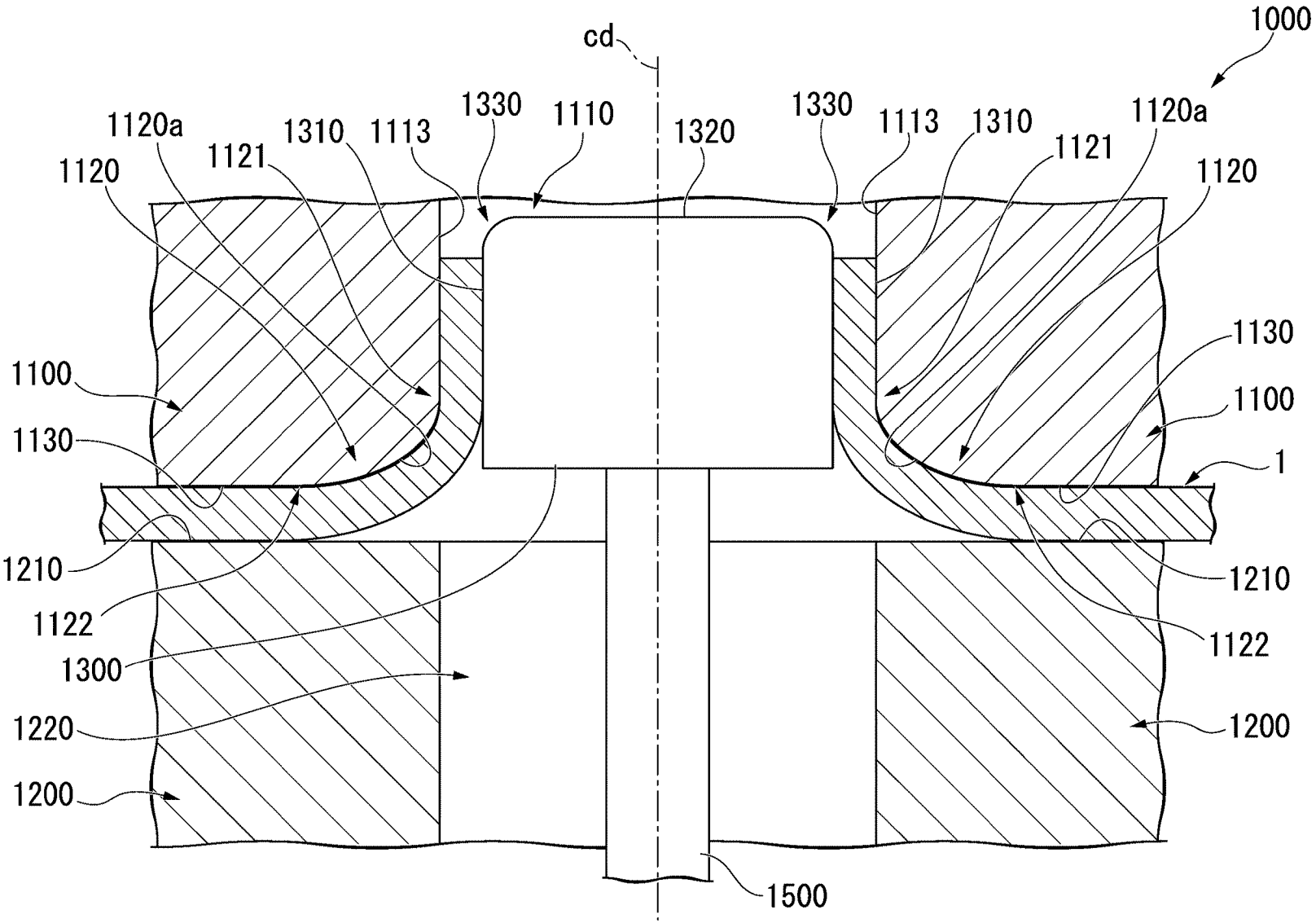
FIG. 13 is a schematic cross-sectional view for describing the buffing processing method according to the third embodiment and is a diagram showing a state in which the punch has moved to a predetermined position and burring processing has been completed.

FIG. 13 shows a state in which the punch 1300 reaches a predetermined position inside the die hole 1110, thereby completing burring processing.

After the state shown in FIG. 13, the punch 1300 is pulled out from the die hole 1110, and the die 1100 and the holder 1200 are moved relative to each other in a direction in which they are separated from each other.

Figure 14:
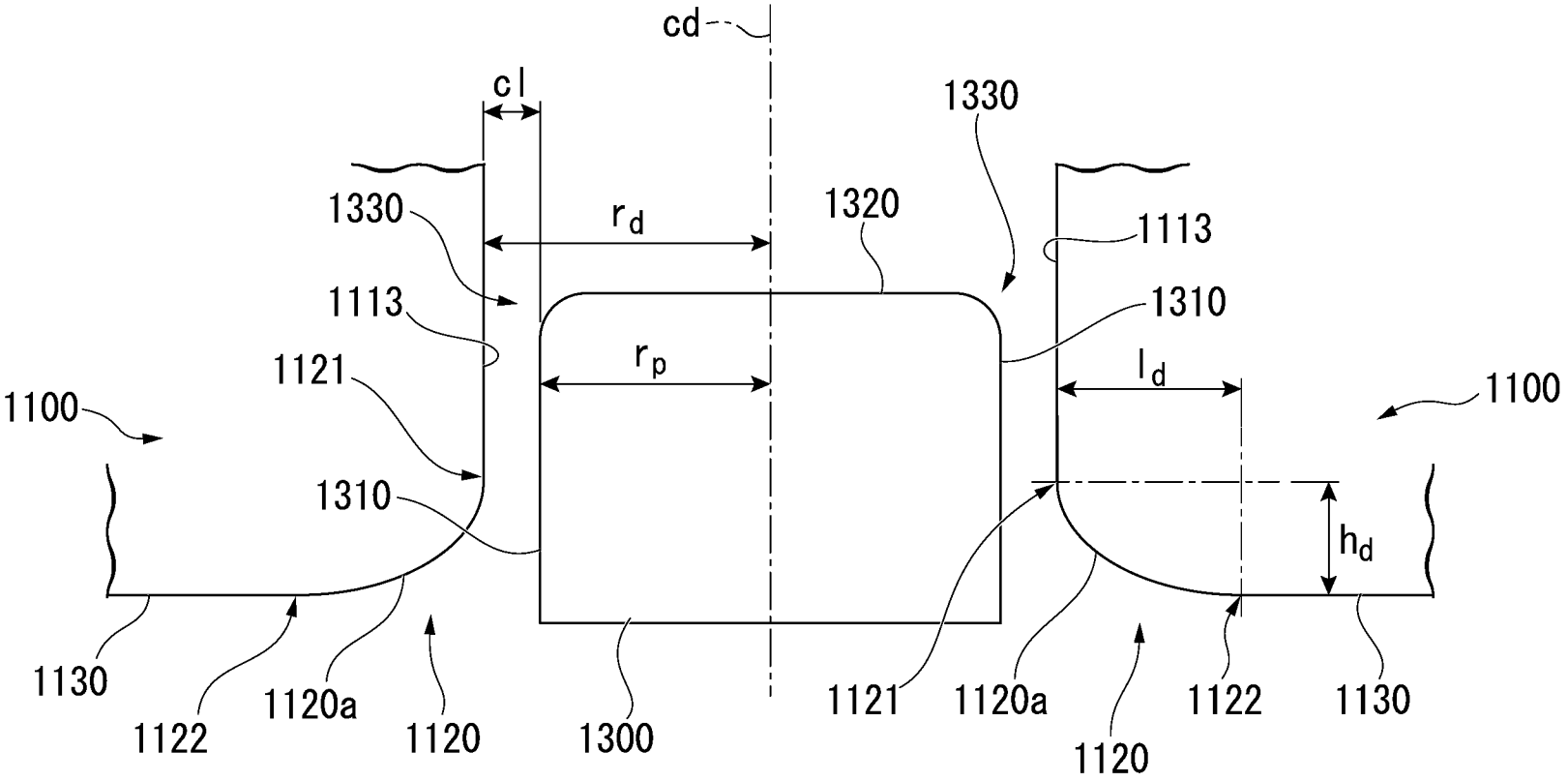
FIG. 14 is a schematic cross-sectional view of the die and the punch for describing shapes of the die and the punch according to the third embodiment.

FIG. 14 is a diagram for describing the mold according to the present embodiment and is a cross-sectional view in the cross-section that passes through the axis cd of the die hole 1110 and is parallel to the axis cd of the die hole 1110.

In the mold 1000 according to the present embodiment, in the cross-section that passes through the axis cd of the die hole 1110 and is parallel to the axis cd of the die hole 1110, the cross-sectional shape of the die shoulder 1120 consists of a curve, and a length Id of the die shoulder 1120 in the direction perpendicular to the axis cd of the die hole 1110 is at least 1.2 times a height $h_d$ thereof in the direction parallel to the axis cd of the die hole 1110.

With such a configuration, a contact area between the workpiece and the die in the forming process can be increased, and thus swelling generated on the inner surface of the curved portion as described above can be inhibited. Further, with such a configuration, a contact between the workpiece and the mold at a high surface pressure can be prevented. For that reason, generation of in-bend cracks in the curved portion of the burring processed portion of the burring processed product can be inhibited. More specifically, by setting the length $l_d$ at least 1.2 times the height $h_d$, cracking depths of the in-bend cracks can be reduced.

In the cross-section that passes through the axis cd of the die hole 1110 and is parallel to the axis cd of the die hole 1110, the length $l_d$ of the die shoulder 1120 in the direction perpendicular to the axis cd of the die hole 1110 is more preferably at least 1.4 times, and further preferably at least 1.6 times the height $h_d$ in the direction parallel to the axis cd of the die hole 1110. With such a configuration, compression strain can be reduced, the generation of in-bend cracks on the inner surface of the curved portion of the burring processed portion of the burring processed product can be inhibited, and the cracking depths can be significantly reduced.

The length Id is a distance from the tip portion 1121, which is the contact point between the cylindrical inner circumferential surface 1113 and the surface 1120*a* of the die shoulder 1120, to the base end portion 1122 of the die shoulder 1120 and is a distance in the direction perpendicular to the axis cd in the cross-section that passes through the axis cd of the die hole 1110 and is parallel to the axis cd of the die hole 1110. The length $l_d$ of the die shoulder 1120 is preferably 0.8 to 5.0 mm, and more preferably 1.0 to 2.5 mm.

The height $h_d$ is a distance from the tip portion 1121, which is the contact point between the cylindrical inner circumferential surface 1113 and the surface 1120*a* of the die shoulder 1120, to the base end portion 1122 of the die shoulder 1120 and is a distance in the direction parallel to the axis cd in the cross-section that passes through the axis cd of the die hole 1110 and is parallel to the axis cd of the die hole 1110. The height $h_d$ of the die shoulder 1120 is preferably 0.5 to 3.0 mm, and more preferably 0.8 to 2.0 mm.

Further, in the cross-section that passes through the axis cd of the die hole 1110 and is parallel to the axis cd of the die hole 1110, the length $l_d$ of the die shoulder 1120 in the direction perpendicular to the axis cd of the die hole 1110 is more preferable at most 3.0 times the height $h_d$ in the direction parallel to the axis cd of the die hole 1110. By setting the length $l_d$ at most 3.0 times the height $h_d$, it is possible to avoid interference with other portions of the burring processed portion of the burring processed product and efficiently obtain the effect of inhibiting generation of the in-bend cracks.

Figure 15:
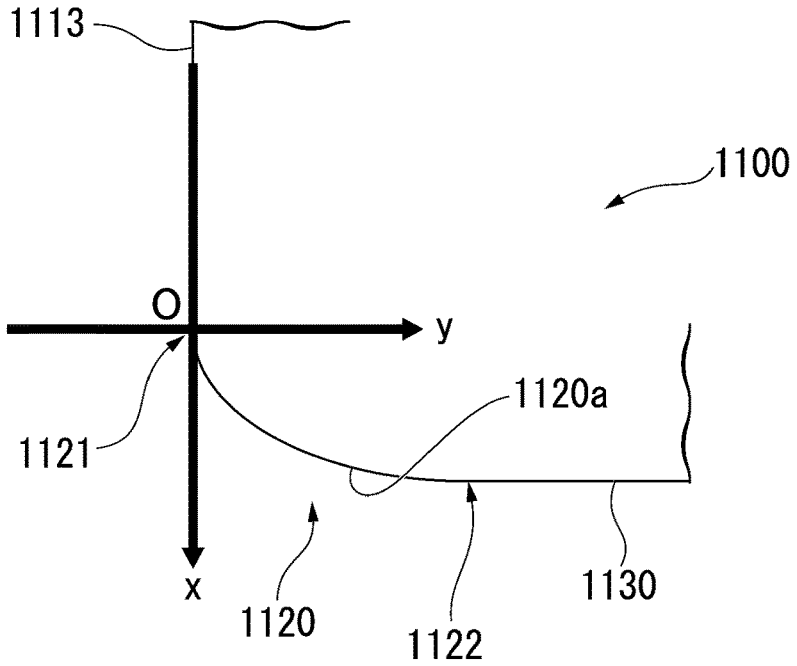
FIG. 15 is a schematic cross-sectional view of the die for describing xy coordinates for defining a cross-sectional shape of a die shoulder.

A curve of the surface 1120*a* of the die shoulder 1120 can be defined as follows. As shown in FIG. 15, in the cross-section that passes through the axis cd of the die hole 1110 and is parallel to the axis cd of the die hole 1110, a direction parallel to the axis cd is defined as the x axis, and a direction perpendicular to the axis cd in the cross-section is defined as the y axis. In addition, a contact point between the cylindrical inner circumferential surface 1113 and the surface 1120*a* of the die shoulder 1120 is defined as the origin O, and a side on which the die shoulder 1120 is located is defined as the positive region. A curve in the xy coordinates can be the curve drawn by the cross-sectional shape of the die shoulder 1120.

The cross-sectional shape of the die shoulder 1120 consists of a curve in the cross-section that passes through the axis cd of the die hole 1110 and is parallel to the axis cd of the die hole 1110 and does not include a straight line. Here, in a case in which there is a straight line, a value obtained by differentiating x twice (second derivative) becomes 0 in a straight line portion when an expression representing the cross-sectional shape of the die shoulder 1120 is expressed by y=f(x) in the above xy coordinates.

Further, the cross-sectional shape of the die shoulder 1120 may be a cross-sectional shape in which the value obtained by differentiating x twice (second derivative) is larger than 0 when an expression representing the cross-sectional shape of the die shoulder 1120 is expressed by y=f(x) in the above xy coordinates. That is, in the above curve drawn by the cross-sectional shape of the die shoulder 1120 (the shape of the surface 1120*a*), the value obtained by differentiating the expression representing the curve twice in the above xy coordinates may be larger than 0. The fact that the value obtained by differentiating the expression representing the curve twice with x becomes larger than 0 means that an overall shape of the curve is convex toward the axis cb side of the die hole 1110 in the range of $h_d \geq x \geq 0$.

A part of the above curve drawn by the cross-sectional shape of the die shoulder 1120 may be a part of a curve represented by a quadratic function or a curve represented by a trigonometric function. By forming a part of the above curve drawn by the cross-sectional shape of the die shoulder 1120 as a part of the curve represented by a quadratic function or a trigonometric function, generation of the in-bend cracks can be further inhibited. Examples of curves represented by quadratic or trigonometric functions include curves such as ellipses, parabolas, sine curves, and cosine curves.

The definition and conditions of the curve represented by a quadratic function or a trigonometric function are the same as those in the first embodiment described above, but the length l of the curved portion 130 is replaced with the length $l_d$ of the die shoulder 1120, and the height h of the curved portion 130 is replaced with the height $h_d$ of the die shoulder 1120.

The cross-sectional shape of the die shoulder 1120 may have a curve represented by a quadratic function or a trigonometric function over the entire region of the die shoulder 1120 starting from the origin O. Alternatively, the cross-sectional shape of the die shoulder 1120 may be a combination of a curve represented by a quadratic function or trigonometric function starting from the origin O and a smooth curve connected to the above curve and extending to the base end portion 132.

A shape of the mold such as the die 1100 is measured using a contact type shape measuring machine. For example, in the case of measuring the die shoulder 1120, shape data is measured and acquired in the direction perpendicular to the axis cd of the die hole 1110 using a contact type shape measuring machine having a probe diameter of 2 mm. A data collection interval is set to 0.05 mm pitch in the direction parallel to the axis cd of the die hole 1110. Further, the curve of the cross-sectional shape of the die shoulder 1120 is obtained by approximating the above shape data to the curve using the least squares method. The approximated curve is a quadratic function or trigonometric function as described above. For obtaining the expression of the curve, a function with a coefficient of determination of at least 0.9 is used. Specifically, the shape data measured in the process of obtaining the expression of the curve is approximated to several curves, and among them, one having a coefficient of determination of at least 0.9 and having the largest coefficient of determination is defined as the curve of the cross-sectional shape. Here, in a case in which the coefficient of determination does not exceed 0.9, the curve may be configured of a plurality of curves. For that reason, an approximating section may be narrowed so that the coefficient of determination is at least 0.9. In addition, in determining whether or not the cross-sectional shape includes a straight line, in a case in which change rates of inclinations of adjacent straight lines are within plus or minus 2% for 3 or more consecutive sections when straight lines determined by the least squares method are sequentially created using five adjacent measurement points, the sections are determined to be a straight line.

In the mold 1000 according to the present embodiment, the punch 1300 has a cylindrical portion having a diameter smaller than a diameter of the die hole 1110, the punch 1300 can be inserted into the die hole 1110 along the axis of the die hole 1110, and when a clearance between the die hole 1110 and the cylindrical portion (the cylindrical inner circumferential surface 1113 of the die hole 1110 and the side circumferential surface 1310 of the punch 1300) is defined as cl, and a height of the cross-sectional shape of the die shoulder 1120 in the direction parallel to the axis of the die hole 1110 is defined as ha, the following Expression 3 may be satisfied.

$$cl < 1.5h_d \qquad \text{Expression 3}$$

More specifically, as shown in FIG. 14, the clearance cl between the die hole 1110 and the cylindrical portion is a difference between a radius $r_d$ of the die hole 1110 and a radius pa of the punch 1300. In the example of FIG. 14, since the axis of the punch 1300 is located on the axis cd of the die hole 1110, the clearance cl can be expressed by $cl = r_d - p_d$. The cylindrical portion may be the entire punch 1300 or a part of the punch 1300 including the side circumferential surface 1310.

Also, in a circumferential direction of the die shoulder, the range in which the cross-sectional shape of the die shoulder has the above curve may be the entire circumferential direction of the die shoulder, or may be a part thereof. For example, in the case of the burring processed product, only a range of the die shoulder corresponding to the range in which the load is intensely applied may be such a curved shape. The length $l_d$ of the die shoulder 1120 may be at most 5.0 times or at most 2.0 times the height $h_d$.

The mold of the present embodiment (burring processing mold) may be provided as a part of a burring processing device further including a drive mechanism that can move the die, the holder, and the punch relative to each other.

Fourth Embodiment

A method for manufacturing a burring processed product according to the present embodiment includes a burring processed portion forming process of forming a burring processed portion on a metal component provided with a prepared hole using a mold including a die having a die hole, a holder, and a punch. In the burring processed portion forming process of the method for manufacturing a burring processed product, a metal component is sandwiched between the die and the holder, and the punch is inserted into the die hole along an axis of the die hole to increase a diameter of the prepared hole and bend a part of the metal component, thereby forming the burring processed portion including an upright portion and a curved portion. In the method for manufacturing the burring processed product, in a cross-section that passes through the axis of the die hole and is parallel to the axis of the die hole, a cross-sectional shape of a die shoulder consists of a curve, and a length thereof in a direction perpendicular to the axis of the die hole is at least 1.2 times a height thereof in a direction parallel to the axis of the die hole. By using the method for manufacturing a buffing processed product having the above configuration, generation of in-bend cracks in the curved portion of the burring processed portion of the burring processed product can be inhibited.

In the buffing processed portion forming process of the method for manufacturing a burring processed product according to the present embodiment, a buffing processing method described in the third embodiment can be preferably used. Also, in the method for manufacturing a burring processed product according to the present embodiment, since each configuration of the third embodiment can be adopted, descriptions thereof will be omitted.

In the method for manufacturing a burring processed product according to the present embodiment, before the burring processed portion forming process, a prepared hole forming process for forming the prepared hole in the metal component may be further provided. In the prepared hole forming process, the prepared hole is formed in the metal component or a metal plate, which is a workpiece, by punching, cutting with a tool, laser cutting, or the like.

In the burring processing method or the method for manufacturing a burring processed product according to the above embodiment, when a plate thickness of the metal component around the prepared hole is defined as t, and a height of the curved portion in a direction parallel to an axis of the burring processed portion is defined as h, the following Expression 1 may be satisfied.

$$h/t<0.6 \qquad \text{Expression 1}$$

In the buffing processing method or the method for manufacturing a burring processed product according to the above embodiment, since generation of in-bend cracks inside the curved portion of the burring processed product can be inhibited, a height h of the curved portion 130 can be designed to be small. Conventionally, in a range in which the height h is smaller than the plate thickness t as in Expression 1, excessive compressive strain is generated inside the curved portion during forming, but in the burring processing method or the method for manufacturing a burring processed product according to the above embodiment, by inhibiting generation of such compression strain, generation of in-bend cracks can be inhibited.

Further, by satisfying Expression 1, there is an advantage that when used as a burring processed product, a contact area between an inner circumferential surface of the upright portion of the burring processed portion and a member inserted into the buffing processed portion is increased. In addition, by satisfying Expression 1, the center of gravity of the burring processed portion can be lowered, and stability of the member inserted into the burring processed portion can be ensured. For this reason, for example, in a case in which the burring processed product is used as an undercarriage component of a vehicle, riding comfort can be improved.

The height h of the curved portion may be the same as the height $h_d$ of the die shoulder.

The plate thickness t around the prepared hole is a plate thickness at an edge portion of the prepared hole (an edge portion 2*a* of the prepared hole 2 in FIGS. 3 and 4, and the like).

The burring processing method or the method for manufacturing a burring processed product according to the above embodiment may be an ironing buffing processing method. In an ironing burring processing method, a clearance between a die and a punch is made smaller than a plate thickness of a workpiece, and the plate thickness of an upright portion is made smaller than the plate thickness of the workpiece.

In the burring processing method or the manufacturing method of the burring processed product according to the above embodiment, when the plate thickness around the prepared hole of the metal component is defined as t, and the plate thickness at an opening side end portion of the upright portion is defined as $t_b$, the following Expression 2 may be satisfied.

$$t_b/t<0.9 \qquad \text{Expression 2}$$

By satisfying Expression 2, the in-bend cracks generated in the curved portion 130 of the burring processed portion 110 can be further inhibited. This is because the workpiece 1 is easily formed while being in contact with the die shoulder 1120 during forming, and buckling of a surface to the outside of the surface due to compressive strain that causes the in-bend cracks is inhibited.

Further, in a case in which the technique of Patent Document 1 is applied to an ironing burring processing method, since the plate thickness is locally reduced and there is a curved portion having a small radius of curvature, a problem due to stress concentration may occur.

In the burring processing method or the method for manufacturing a burring processed product according to the above embodiment, the metal component may be a metal plate. Also, the metal components may be plated or painted.

In addition, in the buffing processing method or the method for manufacturing a buffing processed product according to the above embodiment, the plate thickness around the prepared hole is preferably at least 2.0 mm. Also, in forming the burring processed portion having a plate thickness of at least 2.0 mm, since its rigidity is high, there is virtually no springback, and thus a shape of the die shoulder corresponds to a shape of a portion formed in contact with the die shoulder in the product (burring processed product) and the shape of the die shoulder may be regarded as being reflected in the product as it is.

In particular, the burring processing method or the method for manufacturing a buffing product according to the above embodiment can be preferably used for a steel member having a tensile strength of at least 780 MPa. Also, the burring processing method or the method for manufacturing a burring product according to the above embodiment can be preferably used for a steel member having a tensile strength of at least 980 MPa. Also, the burring processing method or the method for manufacturing a burring product according to the above embodiment can be preferably used for a steel member having a tensile strength of at least 1180 MPa.

Fifth Embodiment

A burring processed product according to the present embodiment has a burring processed portion including an upright portion and a curved portion, and in a cross-section that passes through an axis of the burring processed portion and is parallel to the axis of the burring processed portion, a cross-sectional shape of the curved portion on an inner surface thereof consists of a curve, and a length of the curved portion in a direction perpendicular to the axis of the burring processed portion is at least 1.2 times a height thereof in a direction parallel to the axis of the buffing processed portion.

In the burring processed product having the above configuration, generation of cracks in the burring processed portion can be inhibited.

Since the burring processed product according to the present embodiment can adopt each configuration of the burring processed product described in the first embodiment, detailed descriptions thereof will be omitted.

The burring processed product according to the present embodiment may satisfy the following Expression 4 when a plate thickness around the curved portion is defined as $t_s$, and a height of the curved portion in a direction parallel to the axis of the burring processed portion is defined as h.

$$h/t_s<0.6 \quad \text{Expression 4}$$

The burring processed product according to the present embodiment may satisfy the following Expression 5 when the plate thickness around the curved portion is $t_s$, and a plate thickness at an opening side end portion of the upright portion is defined as tn.

$$t_b/t_s<0.9 \quad \text{Expression 5}$$

As the plate thickness is around the curved portion, a plate thickness at the base end portion 132 of the curved portion 130 as shown in FIG. 5 may be adopted.

The burring processed product according to the present embodiment may be any of a lower arm, a trailing arm, and an upper arm used in a vehicle.

Since the burring processed product according to the present embodiment can inhibit the generation of cracks in the burring processed portion, it can be preferably adopted for a lower arm, a trailing arm, an upper arm, and the like, which are components having the burring processed portion.

The burring processed product according to the present embodiment is a lower arm used for a vehicle and may further have a cylindrical portion and a cylindrical flange portion. In the lower arm, in a plane that is perpendicular to the axis of the burring processed portion and passes through a center C in a length direction of the cylindrical portion on an axis of the cylindrical portion, when an intersection between the axis of the burring processed portion and the plane is defined as an intersection A, an intersection between an axis of the cylindrical flange portion and the plane is defined as an intersection B, and a smaller one of angles between a line segment AB connecting the intersection A to the intersection B and a line segment AC connecting the intersection A to the center C is defined as θ, and in the range of 2θ from the line segment AB to a side on which the center C is located, and in the range of 2θ from the line segment AB to a side opposite to the side on which the center C is located, with the intersection A set as a center, in the cross-section that passes through the axis of the burring processed portion and is parallel to the axis of the burring processed portion, the cross-sectional shape of the curved portion on the inner surface consists of a curve, and the length of the curved portion in the direction perpendicular to the axis of the burring processed portion is at least 1.2 times the height in the direction parallel to the axis of the burring processed portion.

Figure 16:
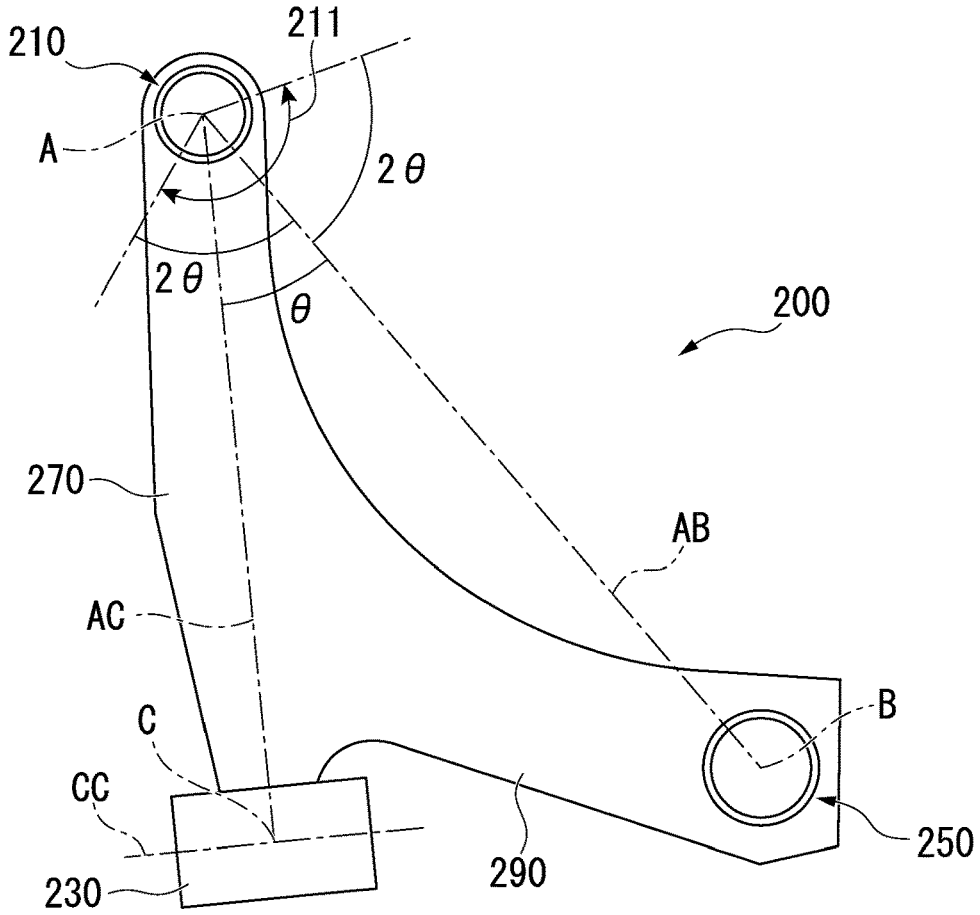
FIG. 16 is a schematic plan view of a lower arm for describing a lower arm according to a fifth embodiment.

FIG. 16 shows an example of a lower arm according to the present embodiment. A lower arm 200 includes a burring processed portion 210, a cylindrical portion 230, a cylindrical flange portion 250, a first element 270 connecting the burring processed portion 210 to the cylindrical portion 230, and a second element 290 connecting the first element 270 to the cylindrical flange portion 250. Also, depending on a shape of the lower arm 200, it may include the burring processed portion 210, the cylindrical portion 230, the cylindrical flange portion 250, the second element 290 connecting the burring processed portion 210 to the cylindrical flange portion 250, and the first element 270 connecting the second element 290 to the cylindrical portion 230.

In a part of a circumferential direction of the burring processed portion 210, in the cross-section that passes through the axis of the buffing processed portion 210 and is parallel to the axis of the burring processed portion 210, the cross-sectional shape of the curved portion on the inner surface consists of a curve, and the length of the curved portion in the direction perpendicular to the axis of the burring processed portion 210 is at least 1.2 times the height in the direction parallel to the axis of the burring processed portion 210. The length of the curved portion in the direction perpendicular to the axis of the burring processed portion 210 is more preferably at least 1.4 times, and further preferably at least 1.6 times the height in the direction parallel to the axis of the burring processed portion 210. Such a range in the circumferential direction of the burring processed portion 210 is referred to as a curve forming range 211.

Since basic configurations of the burring processed portion 210 according to the present embodiment in the curve forming range 211 is the same as that of the burring processed portion of the first embodiment, detailed descriptions thereof will be omitted. Next, the curve forming range 211 in the circumferential direction of the burring processed portion 210 will be described.

First, a plane that is perpendicular to the axis of the burring processed portion 210 (not shown) and passes through the center C in the length direction of the cylindrical portion 230 on the axis cc of the cylindrical portion 230 is defined. For example, the paper surface of FIG. 16 is parallel to this plane. Further, the axis of the burring processed portion 210 is orthogonal to the paper surface of FIG. 16.

The intersection between the axis of the burring processed portion 210 and the plane is defined as the intersection A, and the intersection between the axis of the cylindrical flange portion and the plane is defined as the intersection B. Further, a smaller one of angles between the line segment AB connecting the intersection A to the intersection B and the line segment AC connecting the intersection A to the center C is defined as θ.

In this case, the curve forming range 211 having the above curve is provided in the range of 2θ from the line segment AB to the side on which the center C is located and the range of 2θ from the line segment AB to the side opposite to the side on which the center C is located, with the intersection A as a center. With such a configuration, deformation characteristics in the range in which a load is particularly applied in the circumferential direction of the buffing processed portion 210 can be improved.

In the circumferential direction of the burring processed portion 210, the curved portion in a range other than the curve forming range 211 may have a surface shape other than the above curve. For example, the curved portion in the range other than the curve forming range 211 may be a curved portion having the same height as the curved portion in the curve forming range 211 and shorter than the length of the curved portion in the curve forming range 211.

It is more preferable that the curve forming range 211 be a range of θ from the line segment AB to the side on which the center C is located and a range of 2θ from the line segment AB to the side opposite to the side on which the center C is located, with the intersection A as the center.

Figure 17:
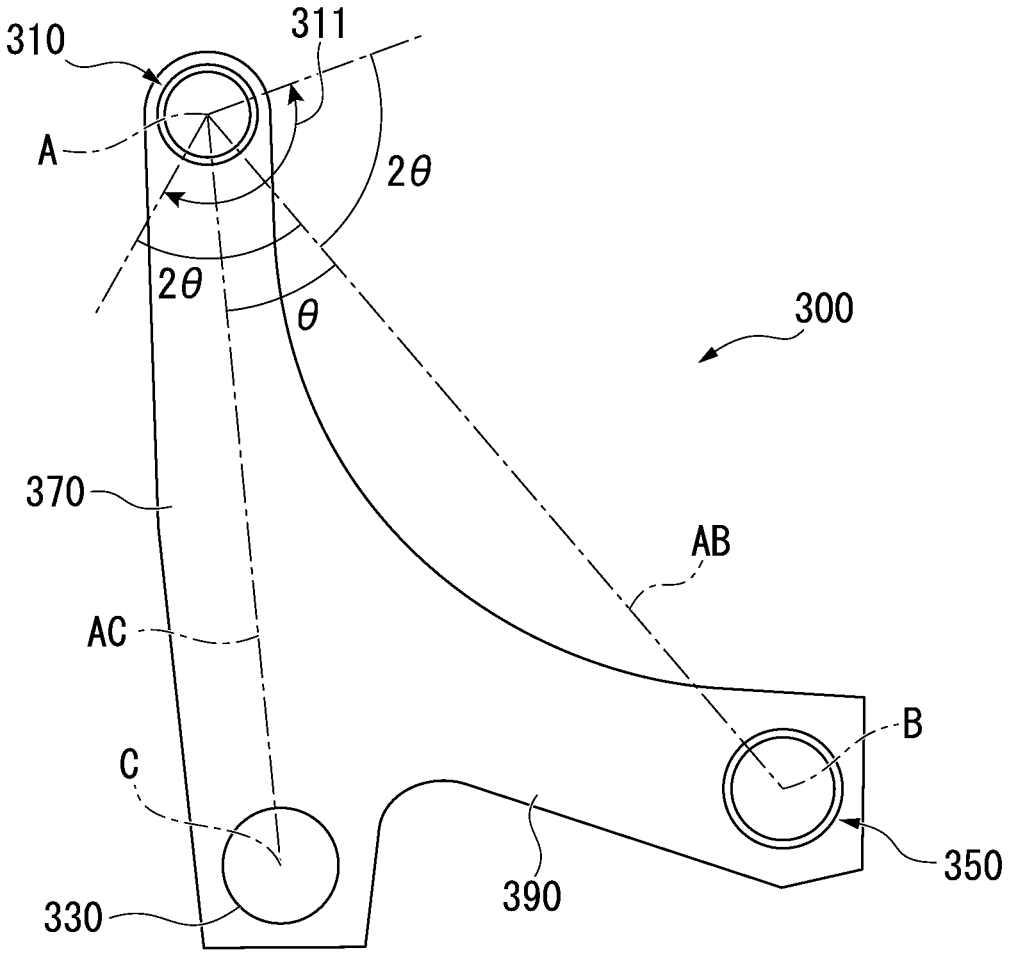
FIG. 17 is a schematic plan view of a lower arm for describing another shape of the lower arm according to the fifth embodiment.

FIG. 17 shows another example of the lower arm according to the present embodiment. In this example, the axis of the cylindrical portion 330 is located in a direction intersecting the paper surface of FIG. 17. As in the example of FIG. 17, an orientation of the axis cc of the cylindrical portion 330 may be appropriately changed depending on a structure of a vehicle on which the lower arm is mounted.

The burring processed product according to the present embodiment has no place in which the radius of curvature of the curved portion suddenly changes, so that a risk of stress concentration can be inhibited.

In the above embodiment, the height of the upright portion of the burring processed portion is more preferably 2 to 20 mm.

The burring processed product according to the present embodiment is not applied to a "structure in which it forms a closed cross-sectional shape by being superposed with another member (for example, a paired burring processed product)", but is preferably applied to a single-sheet structure basically configured of a single member. In a case in which such a buffing processed product having a single-sheet structure is particularly adopted as an undercarriage component of a vehicle, a contact area between an inner circumferential surface of the upright portion of the burring processed portion and a member inserted into the burring processed portion can be increased, stability of the member inserted in the burring processed portion can be ensured, and riding comfort can be improved.

EXAMPLES

Experimental Example 1

Comparative Example 1

A prepared hole with a diameter of 42 mm was provided in a steel member having a tensile strength of 980 MPa and a plate thickness of 2.9 mm, and the prepared hole was subjected to burring processing with each mold under the following conditions.

Punch diameter: 50.00 mm
Punch shoulder R: 10 mm
Die hole diameter: 54.64 mm
Clearance between punch and die hole: 2.32 mm
Cross-sectional shape of die shoulder: Shape with radius of curvature of 1.0 to 2.5 mm.

In Comparative Example 1, burring processing was performed using each mold in which the height $h_d$ of the die shoulder was set to values shown in Table 1. A cross-sectional shape of the die shoulder was formed as a part of a circle having a constant radius of curvature. For that reason, a die used in Comparative Example 1 has the same height $h_d$ and length $l_d$ in the cross-sectional shape of the die shoulder. In the following examples, the cross-sectional shape of the die shoulder is a shape of a surface of the die shoulder in the cross-section that passes through the axis of the die hole and is parallel to the axis of the die hole, as described in the above embodiments.

Table 1 shows results of presence or absence of generation of mold galling and presence or absence of generation of in-bend cracks in the case of the height $h_d$ of the die shoulder. The presence or absence of mold galling is visually determined, and a case in which there is no adhesion of the steel member to the mold (or the mold to the steel member) was designated as "○ (good)," and a case in which the adhesion is observed was designated as "x (bad)". Mold galling is adhesion between a material and a mold and is a phenomenon in which a part of a surface of a material sticks to a mold. Mold galling occurs when a material and a mold slide under high surface pressure, and when mold galling occurs, a product is scratched, resulting in poor quality. The presence or absence of in-bend cracks was determined by polishing a cross-section of a cut sample and observing it with an optical microscope. A case in which the maximum crack is at most 10 um was designated as "○ (good)," and a case in which the maximum crack exceeds 10 um was designated as "x (bad)".

TABLE 1

| | Mold | | | |
|---|---|---|---|---|
| | 1-A | 1-B | 1-C | 1-D |
| $h_d$ (mm) | 2.5 | 2.0 | 1.5 | 1.0 |
| Presence or absence of generation of mold galling | ○ | ○ | ○ | × |
| Presence or absence of generation of in-bend cracks | ○ | ○ | ○ | × |

Comparative Example 2

Similarly to Comparative Example 1, a prepared hole having a diameter of 42 mm was provided in a steel member having a tensile strength of 980 MPa and a plate thickness of 2.9 mm, and the prepared hole was subjected to buffing processing with each mold under the following conditions.

Punch diameter: 50.00 mm
Punch shoulder R: 10 mm
Die hole diameter: 54.64 mm
Clearance between punch and die hole 2.32 mm
Cross-sectional shape of die shoulder: Shape having curved portion having radius of curvature of 0.8 mm at tip portion and base end portion of die shoulder and straight portion between them.

In Comparative Example 2, burring processing was performed with each mold in which the height $h_d$ of the die shoulder and the length $l_d$ of the die shoulder were set to values shown in Table 2. In Comparative Example 2, a cross-sectional shape of the die shoulder is a shape having a curved portion having a radius of curvature of 0.8 mm at a tip portion and a base end portion of the die shoulder and a straight portion between them, which is different from Comparative Example 1.

Table 2 shows results of presence or absence of generation of mold galling and presence or absence of generation of in-bend cracks in the case of the height $h_d$ of the die shoulder and the length $l_d$ of the die shoulder. Evaluation criteria in Table 2 are the same as in Comparative Example 1.

TABLE 2

| | Mold | | | |
|---|---|---|---|---|
| | 2-A | 2-B | 2-C | 2-D |
| $h_d$ (mm) | 2.5 | 2.0 | 1.5 | 1.0 |
| $l_d$ (mm) | 3.3 | 2.6 | 2.0 | 1.3 |

TABLE 2-continued

| | Mold | | | |
|---|---|---|---|---|
| | 2-A | 2-B | 2-C | 2-D |
| Presence or absence of generation of mold galling | ○ | × | × | × |
| Presence or absence of generation of in-bend cracks | ○ | ○ | × | × |

Example 1

Similarly to Comparative Example 1, a prepared hole having a diameter of 42 mm was provided in a steel member having a tensile strength of 980 MPa and a plate thickness of 2.9 mm, and the prepared hole was subjected to buffing processing with each mold under the following conditions.

Punch diameter: 50.00 mm

Punch shoulder R: 10 mm

Die hole diameter: 54.64 mm

Clearance between punch and die hole: 2.32 mm

Cross-sectional shape of die shoulder: Shape including part of ellipse.

In Example 1, burring processing was performed with each mold in which the height $h_d$ of the die shoulder and the length $l_d$ of the die shoulder were set to values shown in Table 3. Example 1 is different from Comparative Example 1 and Comparative Example 2 in that the cross-sectional shape of the die shoulder is a shape including a part of an ellipse.

TABLE 3

| Mold | 3-A | 3-B | 3-C | 3-D | 3-E | 3-F | 3-G | 3-H |
|---|---|---|---|---|---|---|---|---|
| $h_d$ (mm) | 2.5 | 2.0 | 1.5 | 1.0 | 1.0 | 1.0 | 1.0 | 1.0 |
| $l_d$ (mm) | 3.3 | 2.6 | 2.0 | 1.3 | 2.5 | 2.0 | 1.7 | 1.5 |
| Presence or absence of generation of mold galling | ○ | ○ | ○ | ○ | ○ | ○ | ○ | ○ |
| Presence or absence of generation of in-bend cracks | ○ | ○ | ○ | ○ | ○ | ○ | ○ | ○ |

Table 3 shows results of presence or absence of generation of mold galling and presence or absence of generation of in-bend cracks in the case of the height $h_d$ of the die shoulder and the length Id of the die shoulder. Evaluation criteria in Table 3 are the same as in Comparative Example 1.

In the buffing processing method according to the present invention, from the results of Experimental Example 1, it has been understood that, even in the case of forming a burring processed product in which the height (height h) of the curved portion of the burring processed portion is small using a mold in which the height $h_d$ of the die shoulder is small, generation of mold galling and in-bend cracks is inhibited. On the other hand, in the conventional burring processing method as shown in Comparative Example 1, in a case in which the height $h_d$ of the die shoulder is extremely small, mold galling and in-bend cracks are generated. In addition, it has been understood that, in a case in which the ironing burring processing is performed using a die having a plurality of bend portions and straight portions in the cross-sectional shape of the die shoulder as shown in Comparative Example 2, when the height $h_d$ of the die shoulder becomes smaller, mold galling and in-bend cracks tend to be generated.

Experimental Example 2

In the present experimental example, for each of the steel members having tensile strengths of 780 MPa, 980 MPa, and 1180 MPa, the length $l_d$ of the die shoulder of the mold used for forming was changed, and depths of cracks generated in the burring processed portion in each steel member was measured.

A plate thicknesses of the steel member was 2.9 mm, and a prepared hole with a diameter of 42 mm was provided in the steel member, and the prepared hole was subjected to burring processing with each mold under the following conditions.

Punch diameter: 50.00 mm

Punch shoulder R: 10 mm

Die hole diameter: 54.64 mm

Clearance between punch and die hole 2.32 mm

Cross-sectional shape of die shoulder: Shape including part of ellipse.

In the present experimental example, the height $h_d$ of the die shoulder was fixed to 1.0 mm, and the length $l_d$ of the die shoulder was changed from 1.0 to 4.5 mm. Also, the cross-sectional shape of the die shoulder was designed to be a part of the ellipse, the radius of the ellipse in a minor axis direction thereof was formed to correspond to the height $h_d$ of the die shoulder, and the radius of the ellipse in a major axis direction thereof was formed to correspond to the length $l_d$ of the die shoulder.

From the burring processed portion, eight cross-sections that pass through the axis of the burring processed portion and are parallel to the axis of the burring processed portion were cut out. These eight cross-sections were cross-sections that were evenly spaced in the circumferential direction of the burring processed portion. Cracking depths in each cross-section were measured. The cracking depths were measured by observing the cut cross-sections with an optical microscope after polishing them.

Figure 18:
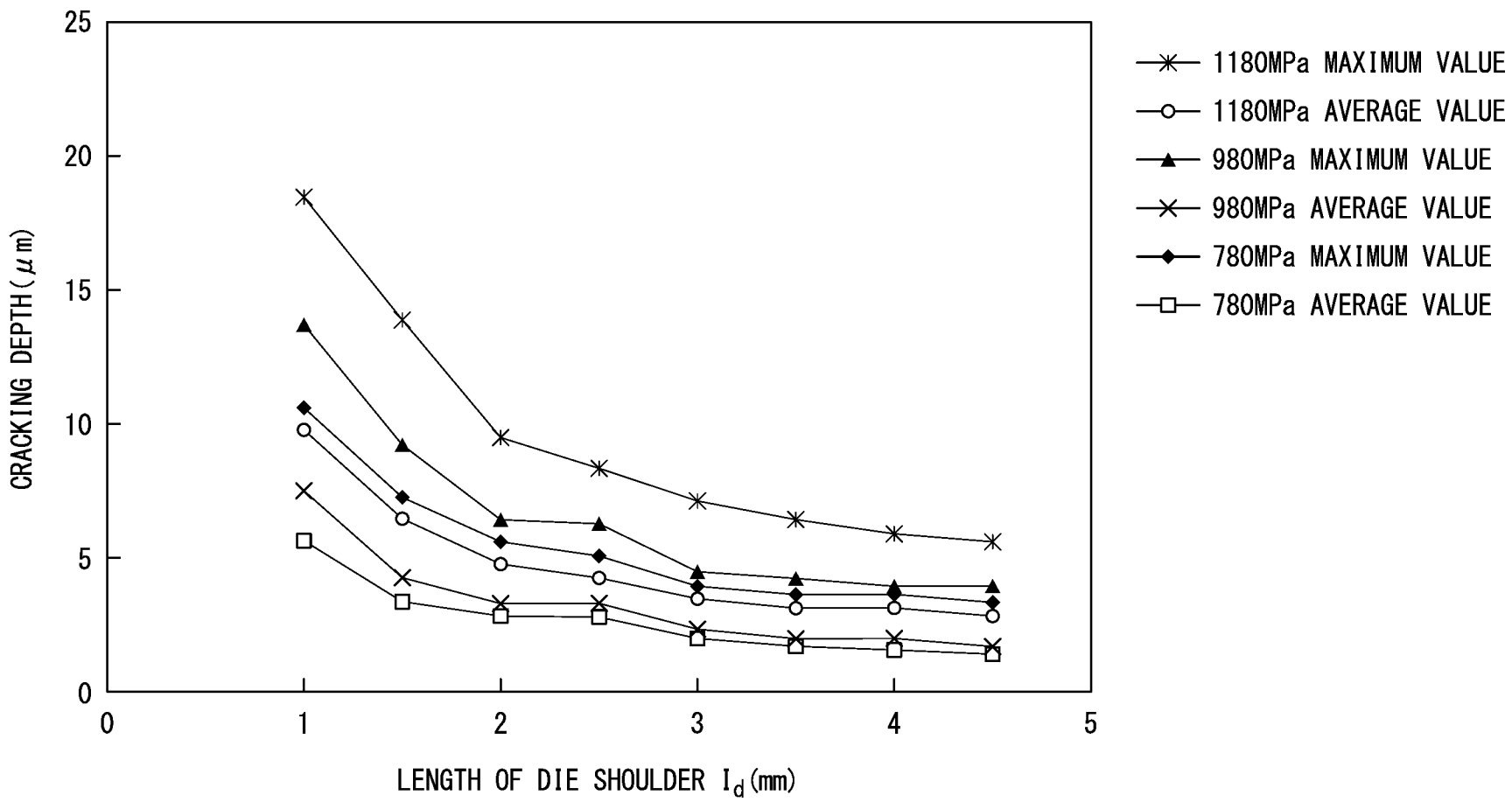
FIG. 18 is a graph showing a relationship between a length (Li) of a die shoulder on an inner surface of a curved portion and cracking depths according to Experimental Example 2.

FIG. 18 shows a graph of the cracking depths (um) in the case of the length $l_d$ (mm) of the die shoulder for each steel member. In FIG. 18, an arithmetic mean value of the cracking depths in these eight cross-sections is displayed as an "average value", and the maximum cracking depth among the cracking depths in the eight cross-sections is displayed as the "maximum value".

As can be understood from this graph, the burring processed portion is formed such that the cross-sectional shape of the curved portion on the inner surface consists of a curve, and the length of the curved portion in the direction perpendicular to the axis of the burring processed portion is at least 1.2 times the height in the direction parallel to the axis of the burring processed portion, and thus depths of the cracks generated in the burring processed portion can be inhibited.

INDUSTRIAL APPLICABILITY

In the present invention, it is possible to provide a buffing processing method, a method for manufacturing a burring processed product, a burring processing mold, a burring processing device, and a burring processed product in which generation of cracks in a curved portion of a burring processed portion can be inhibited, and thus the present invention has high industrial applicability.

BRIEF DESCRIPTION OF REFERENCE SYMBOLS

1 Metal component
2 Prepared hole
100 Burring processed product
110, 210 Burring processed portion
120 Upright portion
130 Curved portion
140 Circumferential region
1000 Mold
1100 Die
1120 Die shoulder
1200 Holder
1300 Punch

The invention claimed is:

1. A burring processing method comprising increasing a diameter of a prepared hole provided in a metal component and bending a part of the metal component to form a burring processed portion including an upright portion and a curved portion, wherein, in a cross-section that passes through an axis of the burring processed portion and is parallel to the axis of the burring processed portion, a cross-sectional shape of the curved portion on an inner surface of the curved portion consists of a curve, and a length of the curved portion in a direction perpendicular to the axis of the burring processed portion is at least 1.2 times a height of the curved portion in a direction parallel to the axis of the burring processed portion, wherein, when a plate thickness around the prepared hole of the metal component is defined as t, and a height of the curved portion in the direction parallel to the axis of the burring processed portion is defined as h, the following Expression 1 is satisfied, $$h/t<0.6 \qquad \text{Expression 1,}$$

wherein, when the plate thickness around the prepared hole of the metal component is defined as t, and a plate thickness of an opening side end portion of the upright portion is defined as to, the following Expression 2 is satisfied, $$t_b/t<0.9 \qquad \text{Expression 2,}$$

wherein a value obtained by differentiating an expression y=f(x) twice with respect to x is larger than 0, and wherein in a cross section passing through the axis of the burring processed portion and parallel to the axis of the burring processed portion, the direction parallel to the axis of the burring processed portion is defined as an x-axis, and the direction perpendicular to the axis of the burring processed portion in the cross-section is defined as a y axis, in an x-y coordinate system defined with the x axis and the y axis, a contact point between an outer circumferential surface of a rising portion and an inner surface of the curved portion is defined as an origin O, a side on which the curved portion is located is defined as a positive region, and the expression y=f(x) represents the cross-sectional shape of the curved portion on the inner surface in the x-y coordinate system.

2. The burring processing method according to claim 1, wherein the burring processed portion is formed in the metal component provided with the prepared hole using a mold including a die having a die hole, a holder, and a punch, wherein the metal component is sandwiched between the die and the holder, the punch is inserted into the die hole along an axis of the die hole to increase the diameter of the prepared hole and to bend the part of the metal component, thereby forming the burring processed portion including the upright portion and the curved portion, and in a cross-section that passes through the axis of the die hole and is parallel to the axis of the die hole, a cross-sectional shape of a die shoulder consists of a curve, and a length of the die shoulder in a direction perpendicular to the axis of the die hole is at least 1.2 times a height of the die shoulder in a direction parallel to the axis of the die hole.

3. A method for manufacturing a burring processed product comprising a burring processed portion forming process of increasing a diameter of a prepared hole provided in a metal component and bending a part of the metal component to form a burring processed portion including an upright portion and a curved portion, wherein, in a cross-section that passes through an axis of the burring processed portion and is parallel to the axis of the burring processed portion, a cross-sectional shape of the curved portion on an inner surface of the curved portion consists of a curve, and a length of the curved portion in a direction perpendicular to the axis of the burring processed portion is at least 1.2 times a height of the curved portion in a direction parallel to the axis of the burring processed portion, wherein, when a plate thickness around the prepared hole of the metal component is defined as t, and a height of the curved portion in the direction parallel to the axis of the burring processed portion is defined as h, the following Expression 1 is satisfied, $$h/t<0.6 \qquad \text{Expression 1,}$$

when the plate thickness around the prepared hole of the metal component is defined as t, and a plate thickness of an opening side end portion of the upright portion is defined as $t_b$, the following Expression 2 is satisfied, $$t_b/t<0.9 \qquad \text{Expression 2,}$$

wherein a value obtained by differentiating an expression y=f(x) twice with respect to x is larger than 0, and wherein in a cross section passing through the axis of the burring processed portion and parallel to the axis of the burring processed portion, the direction parallel to the axis of the burring processed portion is defined as an x-axis, and the direction perpendicular to the axis of the burring processed portion in the cross-section is defined as a y axis, in an x-y coordinate system defined with the x axis and the y axis, a contact point between an outer circumferential surface of a rising portion and an inner surface of the curved portion is defined as an origin O, a side on which the curved portion is located is defined as a positive region, and the expression y=f(x) represents the cross-sectional shape of the curved portion on the inner surface in the x-y coordinate system.

4. The method for manufacturing the burring processed product according to claim 3, wherein the burring processed portion is formed in the metal component provided with the prepared hole using a mold including a die having a die hole, a holder, and a punch, wherein, the metal component is sandwiched between the die and the holder, the punch is inserted into the die hole along an axis of the die hole to increase the diameter of the prepared hole and to bend the part of the metal component, thereby forming the burring processed portion including the upright portion and the curved portion, and in a cross-section that passes through the axis of the die hole and is parallel to the axis of the die hole, a cross-sectional shape of a die shoulder consists of a curve, and a length of the die shoulder in a direction perpendicular to the axis of the die hole is at least 1.2 times a height of the die shoulder in a direction parallel to the axis of the die hole.

5. The method for manufacturing a burring processed product according to claim 3, further comprising a prepared hole forming process of forming the prepared hole in the metal component before the burring processed portion forming process.

6. A burring processing mold comprising a die having a die hole, a holder holding a workpiece together with the die, and a punch movable relative to the die and the holder, wherein, in a cross-section that passes through an axis of the die hole and is parallel to the axis of the die hole, a cross-sectional shape of a die shoulder consists of a curve, and a length of the die shoulder in a direction perpendicular to the axis of the die hole is at least 1.2 times a height of the die shoulder in a direction parallel to the axis of the die hole, wherein the punch includes a cylindrical portion having a diameter smaller than a diameter of the die hole, and the punch is configured to be inserted into the die hole along the axis of the die hole, and when a clearance between the die hole and the cylindrical portion is defined as cl and a height of the die shoulder in a direction parallel to the axis of the die hole in the cross-sectional shape is defined as $h_d$, the following Expression 3 is satisfied, $$cl<1.5h_d \quad \text{Expression 3,}$$

wherein a value obtained by differentiating an expression y=f(x) twice with respect to x is larger than 0, and wherein in a cross section passing through the axis of the die hole and parallel to the axis of the die hole, the direction parallel to the axis of the die hole is defined as an x-axis, and the direction perpendicular to the axis of the die hole in the cross-section is defined as a y axis, in an x-y coordinate system defined with the x axis and the y axis, a contact point between a cylindrical inner circumferential surface and a surface of the die shoulder is defined as an origin O, a side on which the die shoulder is located is defined as a positive region, and the expression y=f(x) represents the cross-sectional shape of the die shoulder in the x-y coordinate system.

7. A burring processing device comprising the burring processing mold according to claim 6, and a drive mechanism configured to move the die, the holder, and the punch relative to each other.

8. A burring processed product comprising a burring processed portion including an upright portion and a curved portion, wherein, in a cross-section that passes through an axis of the burring processed portion and is parallel to the axis of the burring processed portion, a cross-sectional shape of the curved portion on an inner surface of the curved portion consists of a curve, and a length of the curved portion in a direction perpendicular to the axis of the burring processed portion is at least 1.2 times a height of the curved portion in a direction parallel to the axis of the burring processed portion, wherein, when a plate thickness around the curved portion is defined as $t_s$, and a height of the curved portion in the direction parallel to the axis of the burring processed portion is defined as h, the following Expression 4 is satisfied, $$h/t_s<0.6 \quad \text{Expression 4,}$$

wherein, when the plate thickness around the curved portion is defined as $t_s$, and a plate thickness of an opening side end portion of the upright portion is defined as $t_b$, the following Expression 5 is satisfied, $$t_b/t_s<0.9 \quad \text{Expression 5,}$$

wherein a value obtained by differentiating an expression y=f(x) twice with respect to x is larger than 0, and wherein in a cross section passing through the axis of the burring processed portion and parallel to the axis of the burring processed portion, the direction parallel to the axis of the burring processed portion is defined as an x-axis, and the direction perpendicular to the axis of the burring processed portion in the cross-section is defined as a y axis, in an x-y coordinate system defined with the x axis and the y axis, a contact point between an outer circumferential surface of a rising portion and an inner surface of the curved portion is defined as an origin O, a side on which the curved portion is located is defined as a positive region, and the expression y=f(x) represents the cross-sectional shape of the curved portion on the inner surface in the x-y coordinate system.

9. The burring processed product according to claim 8, wherein the burring processed product is any of a lower arm, a trailing arm, and upper arm, which are used in a vehicle.

10. The burring processed product according to claim 8, wherein the burring processed product is a lower arm used in a vehicle, which further includes a cylindrical portion and a cylindrical flange portion, in a plane that is perpendicular to the axis of the burring processed portion and passes through a center C in a length direction of the cylindrical portion on an axis of the cylindrical portion, when an intersection between the axis of the burring processed portion and the plane is defined as an intersection A, an intersection between an axis of the cylindrical flange portion and the plane is defined as an intersection B, and the smaller angle between a line segment AB connecting the intersection A to the intersection B and a line segment AC connecting the intersection A to the center C is defined as θ, and in the range of 2θ from the line segment AB to a side on which the center C is located, and in the range of 2θ from the line segment AB to a side opposite to the side on which the center C is located, with the intersection A set as a center, in the cross-section that passes through the axis of the burring processed portion and is parallel to the axis of the burring processed portion, the cross-sectional shape of the curved portion on the inner surface consists of a curve, and the length of the curved portion in the direction perpendicular to the axis of the burring processed portion is at least 1.2 times the height of the curved portion in the direction parallel to the axis of the burring processed portion.

* * * * *